US008995894B2

(12) United States Patent
Jeong et al.

(10) Patent No.: US 8,995,894 B2
(45) Date of Patent: Mar. 31, 2015

(54) IMAGE FUSING APPARATUS USING CARBON NANO-TUBE HEATER

(75) Inventors: Hee-moon Jeong, Yongin-si (KR); Jin-seung Choi, Suwon-si (KR); Eun-bong Han, Suwon-si (KR); Keon Kuk, Yongin-si (KR); Young-min Cheong, Seoul (KR); Mu-kun An, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 79 days.

(21) Appl. No.: 13/599,165

(22) Filed: Aug. 30, 2012

(65) Prior Publication Data

US 2013/0064587 A1 Mar. 14, 2013

(30) Foreign Application Priority Data

Sep. 8, 2011 (KR) ..... 10-2011-0091270
Dec. 19, 2011 (KR) ..... 10-2011-0137747

(51) Int. Cl.
*G03G 15/20* (2006.01)

(52) U.S. Cl.
CPC ..... *G03G 15/2057* (2013.01); *G03G 15/2039* (2013.01); *G03G 15/2089* (2013.01); *G03G 15/2053* (2013.01); *G03G 2215/2032* (2013.01);

(Continued)

(58) Field of Classification Search
CPC ..... G03G 15/2053
USPC ..... 399/329
See application file for complete search history.

(56) References Cited

U.S. PATENT DOCUMENTS 7,228,082 B1 6/2007 Davidson et al.
7,273,095 B2 * 9/2007 Li et al. ..... 165/185
8,285,185 B2 * 10/2012 Sasaki et al. ..... 399/333

(Continued)

FOREIGN PATENT DOCUMENTS

EP 1847889 10/2007
EP 1847889 * 12/2007 ..... G03G 15/20

(Continued)

OTHER PUBLICATIONS

Huang, et al., Aligned Carbon Nanotube Composite Films for Thermal Management, Advanced Materials, Adv. Mater 2005, 17, pp. 1652-1656.*

(Continued)

*Primary Examiner* — Clayton E Laballe
*Assistant Examiner* — Kevin Butler
(74) *Attorney, Agent, or Firm* — Staas & Halsey LLP

(57) ABSTRACT

An image fusing apparatus includes a heating belt including a resistance heating layer, an insulating layer formed on an inner surface of the resistance heating layer, and a release layer formed on an outer surface of the resistance heating layer; a heating supporting roller disposed (positioned) inside the heating belt and rotating with the heating belt; a pressing roller disposed (positioned) parallel to the heating supporting roller and in contact with the outer surface of the heating belt to form a nip; and an electricity supplying member to supply electricity to the resistance heating layer of the heating belt. A thickness of paper non-contact areas of opposite side end portions of the resistance heating layer of the heating belt is the same as or thicker than the thickness of a paper contact area of a middle portion of the resistance heating layer thereof.

44 Claims, 29 Drawing Sheets

(52) U.S. Cl.
CPC .... *G03G 15/2064* (2013.01); *G03G 2215/2016* (2013.01); *G03G 2215/2035* (2013.01)
USPC ..... 399/329

(56) References Cited

U.S. PATENT DOCUMENTS

| | | | | |
|---|---|---|---|---|
| 8,355,661 | B2 * | 1/2013 | Kim et al. | 399/330 |
| 8,437,674 | B2 * | 5/2013 | Lee et al. | 399/333 |
| 2009/0162637 | A1 * | 6/2009 | Grabowski et al. | 428/323 |
| 2010/0089899 | A1 * | 4/2010 | Dohring et al. | 219/213 |
| 2010/0260526 | A1 * | 10/2010 | Lee et al. | 399/333 |
| 2011/0044739 | A1 * | 2/2011 | Kim et al. | 399/333 |
| 2011/0064442 | A1 * | 3/2011 | Sasaki et al. | 399/69 |
| 2012/0051810 | A1 * | 3/2012 | Yoshida et al. | 399/333 |
| 2013/0064587 | A1 * | 3/2013 | Jeong et al. | 399/329 |
| 2013/0142553 | A1 * | 6/2013 | Lee et al. | 399/333 |
| 2013/0251425 | A1 * | 9/2013 | Son et al. | 399/331 |

FOREIGN PATENT DOCUMENTS

| | | | | |
|---|---|---|---|---|
| JP | 2004281123 | * | 10/2004 | G02G 15/20 |
| WO | 2005/062133 | | 7/2005 | |
| WO | WO2005062133 | * | 7/2005 | G03G 15/20 |

OTHER PUBLICATIONS

Shirakata, Jiro, WO 2005/062133, PCT, Japan, Jul. 7, 2005.*
Extended European Search Report dated Apr. 24, 2013 in European Patent Application No. 12183348.7.
Partial European Search Report for European Application No. 12183348.7, mailed Jan. 14, 2013.

* cited by examiner

IMAGE FUSING APPARATUS USING CARBON NANO-TUBE HEATER

CROSS-REFERENCE TO RELATED APPLICATIONS

This application claims the priority benefit from Korean Patent Applications No. 2011-0091270 filed Sep. 8, 2011 and No. 2011-0137747 filed Dec. 19, 2011 in the Korean Intellectual Property Office, the disclosures of which are incorporated herein by reference in their entirety.

BACKGROUND

1. Field

Embodiments relate to an image fusing apparatus used in an electro photographic type image forming apparatus. More particularly, the present disclosure relates to an image fusing apparatus including a heater using carbon nano-tubes.

2. Description of the Related Art

As an image fusing apparatus fusing a developer image on a printing medium, a heating roller method that heats an entire surface of a heat roller has been widely used. However, nowadays, a belt fusing method having a low heat capacity is widely used in order to reduce time it takes and energy used to heat to a fusing temperature.

FIG. 1 illustrates an example of a belt type image fusing apparatus using the belt fusing method. Referring to FIG. 1, the belt type image fusing apparatus 200 includes a pressing roller 201, a fusing belt 203 that receives a rotation force from the pressing roller 201 so as to rotate, a guiding member 205 that is disposed inside the fusing belt 203 to guide rotation of the fusing belt 203, and a ceramic heater 207, that is, a heating member that is disposed on the guiding member 205, and heats a nip portion of the fusing belt 203.

Since the belt type image fusing apparatus 200 is a local heating method that heats only the nip portion of the image fusing apparatus 200 and thus has a low heat capacity, a temperature rising (increasing) standby time can be reduced and a width of the nip portion can be increased. However, the fusing belt 203 is formed in a thin film shape in order to increase thermal conductivity and is rotated by friction with the pressing roller 201 in the nip portion. A slip may occur between a printing medium P and the fusing belt 203 when the fusing belt 203 rotates at a high speed due to the structure of the fusing belt 203 as described above. Accordingly, reliability problems of the fusing belt 203 may occur. In order to solve the friction problem, lubrication may be applied. However, external contamination problems may occur due to the lubrication. Further since the ceramic heater 207 of the heating member is formed in a substantially flat plate shape, the belt type image fusing apparatus 200 has an advantage that when a printing medium P passes through the nip portion, curl does not occur. However, since there is an area where radius of curvature of the fusing belt 203 rapidly changes, durability of the fusing belt 203 may be reduced due to cumulative fatigue caused by bending.

For solving the problems, a belt type image fusing apparatus using a fusing belt having a resistance heating layer is provided. However, when this belt type image fusing apparatus performs continuously printing, temperature of a paper non-contact area of the fusing belt with which a printing medium is not in contact is highly increased so that the fusing belt and parts around the fusing belt are damaged.

SUMMARY

Embodiments have been developed in order to overcome the above drawbacks and other problems associated with the conventional arrangement. An aspect of the present disclosure relates to an image fusing apparatus that has a fast temperature rising (increasing) speed, a large energy saving effect and excellent heating uniformity, and can prevent temperature of a paper non-contact area of a fusing belt from increasing.

According to an aspect of one or more embodiments, there is provided an image fusing apparatus, which may include a heating belt including a resistance heating layer, an insulating layer formed on an inner surface of the resistance heating layer, and a release layer formed on an outer surface of the resistance heating layer; a heating supporting roller disposed (positioned) inside the heating belt and rotating with the heating belt; a pressing roller disposed (positioned) parallel to the heating supporting roller and in contact with the outer surface of the heating belt to form a nip; and an electricity supplying member to supply electricity to the resistance heating layer of the heating belt, wherein a thickness of paper non-contact areas of opposite side end portions of the resistance heating layer of the heating belt is the same as or thicker than the thickness of a paper contact area of a middle portion of the resistance heating layer thereof.

A width of the paper contact area of the resistance heating layer may be the same as that of a maximum size printing medium that the resistance heating layer can fuse.

The thickness of the paper non-contact area of the resistance heating layer may be once to three times to the thickness of the paper contact area.

An outer diameter of the resistance heating layer may be constant throughout a whole length of the resistance heating layer. an outer diameter of the heating supporting roller may be constant throughout a whole length of the heating supporting roller, and the insulating layer disposed between the resistance heating layer and the heating supporting roller may have an outer diameter that complementarily changes depending on change of thickness of the resistance heating layer throughout a whole length of the insulating layer.

An outer diameter of the resistance heating layer may be constant throughout a whole length of the resistance heating layer. an outer diameter of the heating supporting roller may have steps corresponding to the thickness of the resistance heating layer, and the insulating layer may have the same thickness through a whole length of the insulating layer.

The resistance heating layer may include carbon nano-tubes.

The resistance heating layer may be formed so that the carbon nano-tubes on which metal as conductive filler is doped are dispersed in a silicon rubber or a polyamide of an elastic member.

The electricity supplying member may be disposed on opposite ends of the heating supporting roller to supply electricity to the resistance heating layer.

The electricity supplying member may be disposed along the opposite side end portions of the heating belt, and the electricity supplying member receives electricity from a brush that is disposed in a direction perpendicular to an axis direction of the heating supporting roller.

The electricity supplying member may be formed in a cap shape to wrap one end of the heating supporting roller, and the cap shape electricity supplying member may be supplied with electricity by a brush that is disposed in contact with the cap shape electricity supplying member in an axial direction of the heating supporting roller.

The image fusing apparatus may include an inner supporting cap supporting an inner surface of the cap shape electricity supplying member; and an outer fixing cap that supports an outer surface of the cap shape electricity supplying member and fixes the cap shape electricity supplying member with respect to the resistance heating layer of the heating supporting roller.

The heating supporting roller may include an elastic layer supporting the heating belt and formed in a cylindrical shape; and a center shaft disposed at a center of the elastic layer.

The pressing roller may be formed so that an elastic layer and a release layer are in sequence laminated on a pressing rotation shaft.

The heating supporting roller may include a hollow cylinder having a width corresponding to the heating belt; and a pair of supporting shafts disposed on opposite ends of the hollow cylinder, and the hollow cylinder and the pair of supporting shafts may be formed of a metal.

The image fusing apparatus may include an auxiliary pressing roller spaced apart at a predetermined interval from the pressing roller, the auxiliary pressing roller disposed to press the heating belt to the heating supporting roller.

The pressing roller may include at least two supporting rollers and a pressing belt rotated by the at least two supporting rollers.

According to an aspect of one or more embodiments, an image fusing apparatus may include a heating belt including a resistance heating layer, a release layer formed on an outer surface of the resistance heating layer and an electricity supplying member to supply electricity to the resistance heating layer; a heating roller disposed (positioned) inside the heating belt and including a non-conductive shaft in contact with the resistance heating layer; and a pressing roller disposed (positioned) parallel to the heating roller and in contact with an outer surface of the heating belt to form a nip, wherein a thickness of paper non-contact areas of opposite side end portions of the resistance heating layer of the heating belt is the same as or thicker than a thickness of a paper contact area of a middle portion of the resistance heating layer thereof.

A width of the paper contact area of the resistance heating layer may be the same as that of a maximum size printing medium that the resistance heating layer can fuse, and the thickness of the opposite side end portions of the resistance heating layer may be once to three times to the thickness of the middle portion.

According to an aspect of one or more embodiments, an image fusing apparatus may include a heating belt including a resistance heating layer, an insulating layer formed on an inner surface of the resistance heating layer, and a release layer formed on an outer surface of the resistance heating layer; a heating supporting roller disposed (positioned) inside the heating belt and rotating with the heating belt; a pressing roller disposed (positioned) parallel to the heating supporting roller and to be in contact with an outer surface of the heating belt to form a nip; and a pair of electricity supplying members to supply electricity to the resistance heating layer of the heating belt and disposed on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt.

The electricity supplying member may include a body portion disposed at one end of the heating supporting roller; and a plurality of projecting portions formed to project at a predetermined interval from the body portion and disposed in contact with the resistance heating layer of the heating belt, and the plurality of projecting portions may form the plurality of contacting portions.

The electricity supplying member may include a body portion disposed at one end of the heating supporting roller; and an extension portion extended from the body portion to correspond to a paper non-contact area of the heating belt; wherein an electrode insulating layer is disposed between the extension portion and the resistance heating layer of the heating belt, a plurality of through holes having a predetermined shape is formed on the electrode insulating layer in a circumferential direction of the heating supporting roller, and the resistance heating layer and the electricity supplying member are electrically connected with each other through a material forming the resistance heating layer and filling up the plurality of through holes.

Each of the plurality of contacting portions may be formed in a band shape.

The plurality of contacting portions may be inclined with respect to a center shaft of the heating supporting roller.

According to an aspect of one or more embodiments, an image fusing apparatus may include a heating belt including a resistance heating layer, a release layer formed on an outer surface of the resistance heating layer, and a conductive layer; a heating supporting member disposed (positioned) inside the heating belt and supporting rotation of the heating belt; a pressing roller disposed (positioned) parallel to the heating supporting member and to be in contact with an outer surface of the heating belt to form a nip; and an electricity supplying member to supply electricity to the resistance heating layer of the heating belt, wherein the conductive layer is formed to be electrically connected with the resistance heating layer on a paper non-contact area of the heating belt, and electrical conductivity of the conductive layer is the same as or larger than electrical conductivity of the resistance heating layer.

The resistance heating layer may be formed so that carbon nano-tubes on which metal as conductive filler is doped are dispersed in a silicon rubber or a polyamide of an elastic member.

The electrical conductivity of the conductive layer may be once to 500 times larger than electrical conductivity of the resistance heating layer.

The conductive layer may be formed of a conductive resin or metal.

When the conductive layer is formed of a metal, the conductive layer may be formed of a metal film having a thickness of 1 nm~999 μm.

The conductive layer may include at least one conductive layer formed on at least one between a top surface of the resistance heating layer and a bottom surface of the resistance heating layer.

The heating belt may include an insulating layer formed on a bottom surface of the resistance heating layer.

The heating belt may include an elastic layer formed between the resistance heating layer and the release layer.

The heating supporting member may include a heating supporting roller, and a nip forming member.

The nip forming member may include a pressure supporting member disposed inside the heating belt and supporting the nip forming member toward the pressing roller.

The conductive layer of the heating belt may be electrically connected with directly the electricity supplying member.

According to an aspect of one or more embodiments, an image fusing apparatus may include a heating belt including a resistance heating layer, and a release layer formed on an outer surface of the resistance heating layer; a heating supporting member disposed (positioned) inside the heating belt and supporting rotation of the heating belt; a pressing roller disposed (positioned) parallel to the heating supporting member and to be in contact with an outer surface of the heating belt to form a nip; and an electricity supplying member to supply electricity to the resistance heating layer of the heating belt, wherein electrical resistance of a paper non-contact area of the heating belt is smaller than electrical resistance of a paper contact area of the heating belt.

Thickness or electrical conductivity of the resistance heating layer of the paper non-contact area of the heating belt may be adjusted to control the electrical resistance.

According to an aspect of one or more embodiments, there is provided an image forming apparatus including an image fusing apparatus, the image fusing apparatus including a heating belt including a resistance heating layer, an insulating layer formed on an inner surface of the resistance heating layer, and a release layer formed on an outer surface of the resistance heating layer; a heating supporting roller positioned inside the heating belt and rotating with the heating belt; a pressing roller positioned parallel to the heating supporting roller and in contact with an outer surface of the heating belt to form a nip; and an electricity supplying member to supply electricity to the resistance heating layer of the heating belt, wherein a thickness of paper non-contact areas of opposite side end portions of the resistance heating layer of the heating belt is the same as or thicker than the thickness of a paper contact area of a middle portion of the resistance heating layer thereof.

According to an aspect of one or more embodiments, there is provided an image fusing apparatus including a heating belt including a resistance heating layer, an insulating layer formed on an inner surface of the resistance heating layer, and a release layer formed on an outer surface of the resistance heating layer; a heating supporting roller positioned inside the heating belt and rotating with the heating belt; and an electricity supplying member to supply electricity to the resistance heating layer of the heating belt, wherein a thickness of paper non-contact areas of the resistance heating layer of the heating belt is the same as or thicker than the thickness of a paper contact area of the resistance heating layer thereof.

According to an aspect of one or more embodiments, there is provided an image fusing apparatus including a heating belt including a resistance heating layer, an insulating layer formed on an inner surface of the resistance heating layer, and a release layer formed on an outer surface of the resistance heating layer; a heating supporting roller positioned inside the heating belt and rotating with the heating belt; and a pair of electricity supplying members to supply electricity to the resistance heating layer of the heating belt and positioned on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt.

According to an aspect of one or more embodiments, there is provided an image fusing apparatus including a heating belt including a resistance heating layer, a release layer formed on an outer surface of the resistance heating layer, and a conductive layer; a heating supporting member positioned inside the heating belt and supporting rotation of the heating belt; and an electricity supplying member to supply electricity to the resistance heating layer of the heating belt, wherein the conductive layer is formed to be electrically connected with the resistance heating layer on a paper non-contact area of the heating belt, and electrical conductivity of the conductive layer is the same as or larger than electrical conductivity of the resistance heating layer.

According to an aspect of one or more embodiments, there is provided an image fusing apparatus, including a heating belt including a resistance heating layer, and a release layer formed on an outer surface of the resistance heating layer; a heating supporting member positioned inside the heating belt and supporting rotation of the heating belt; and an electricity supplying member to supply electricity to the resistance heating layer of the heating belt, wherein electrical resistance of a paper non-contact area of the heating belt is smaller than electrical resistance of a paper contact area of the heating belt.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
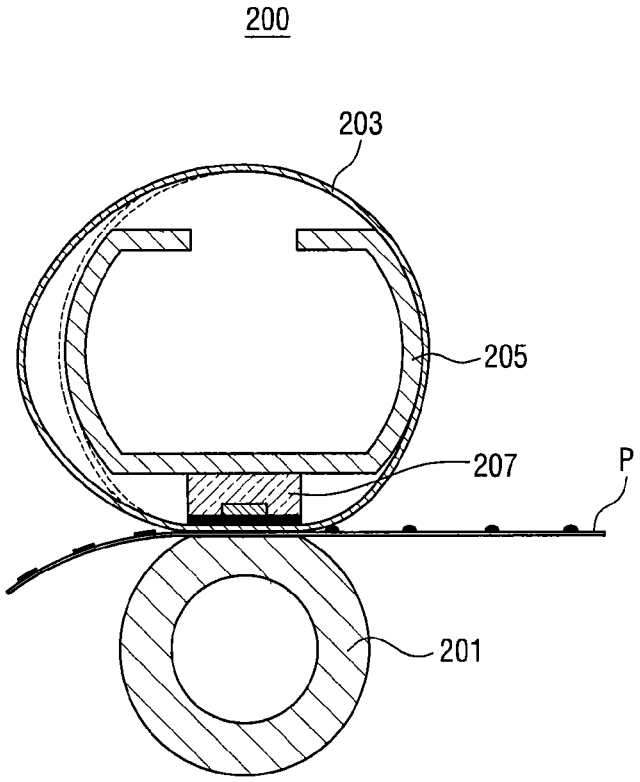
FIG. 1 (PRIOR ART)
FIG. 1 is a sectional view schematically illustrating a conventional belt type image fusing apparatus.

Hereinafter, embodiments will be described in detail with reference to the accompanying drawings. Throughout the drawings, like reference numerals will be understood to refer to like parts, components and structures.

The matters defined herein, such as a detailed construction and elements thereof, are provided to assist in a comprehensive understanding of this description. Thus, it is apparent that embodiments may be carried out without those defined matters. Also, well-known functions or constructions are omitted to provide a clear and concise description of embodiments. Further, dimensions of various elements in the accompanying drawings may be arbitrarily increased or decreased for assisting in a comprehensive understanding.

Figure 2:
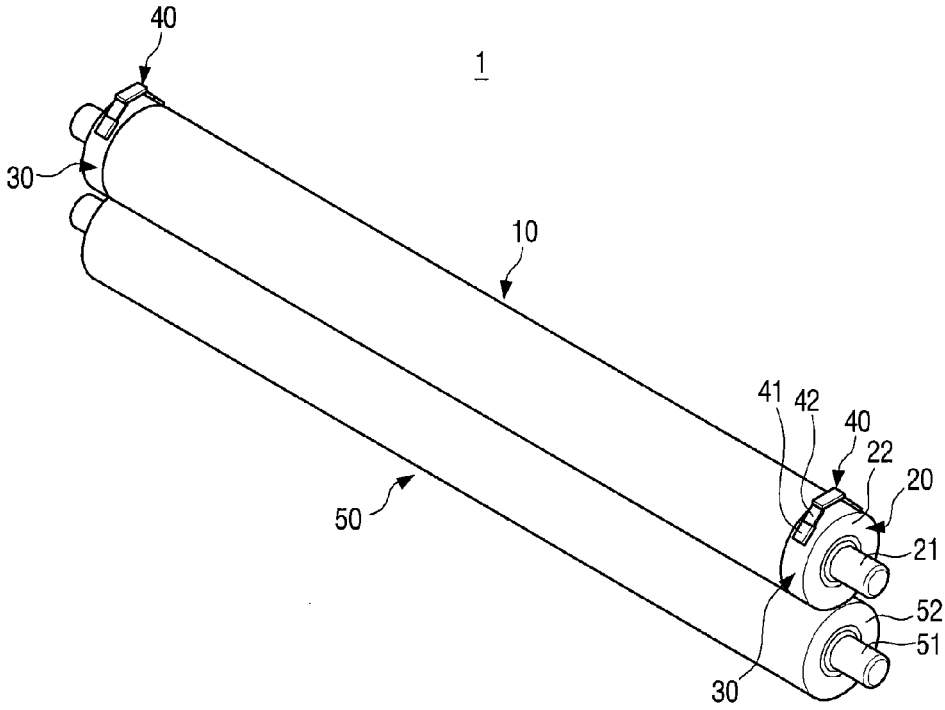
FIG. 2 is a perspective view illustrating an image fusing apparatus according to an embodiment.
Figure 3:
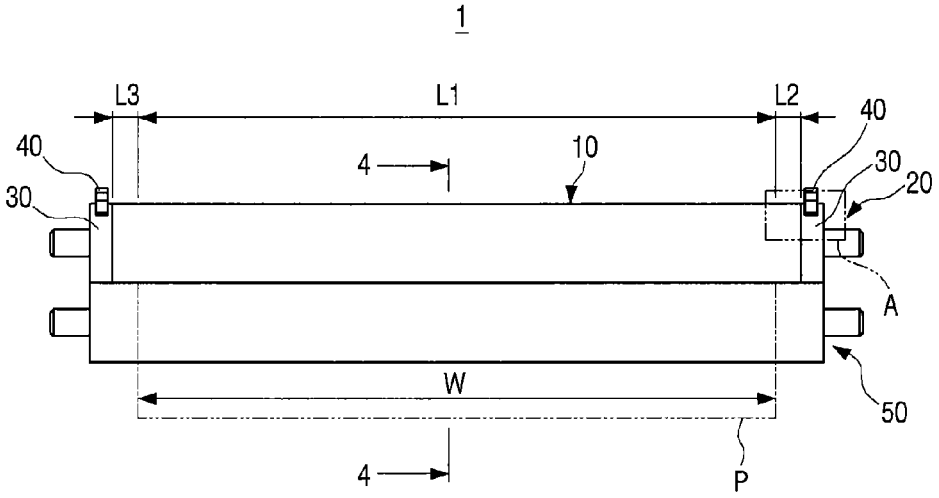
FIG. 3 is a front view illustrating the image fusing apparatus of FIG. 2.
Figure 4:
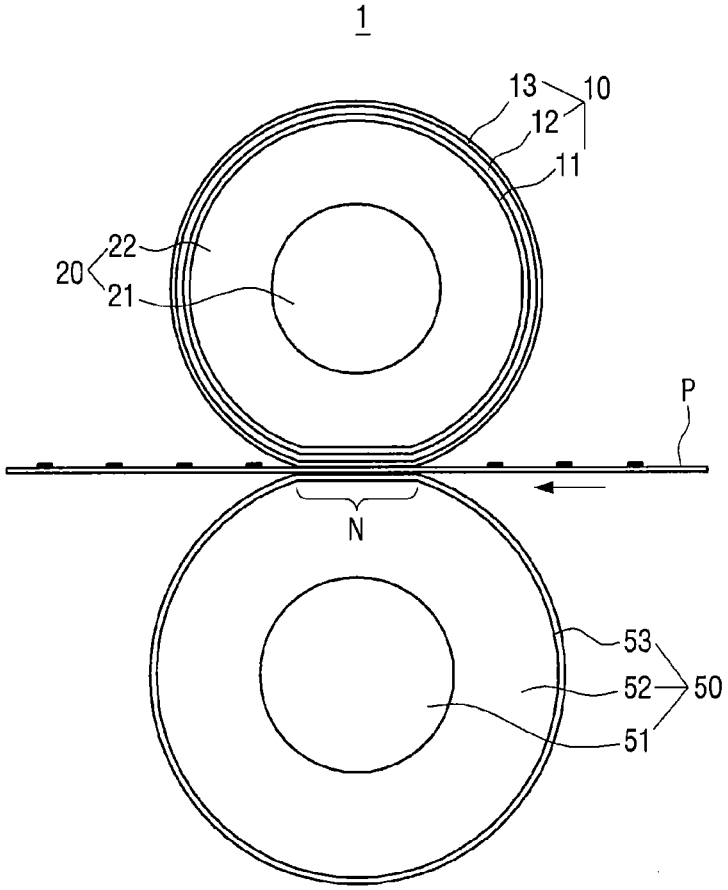
FIG. 4 is a sectional view illustrating the image fusing apparatus taken along a line 4-4 in FIG. 3.
Figure 5:
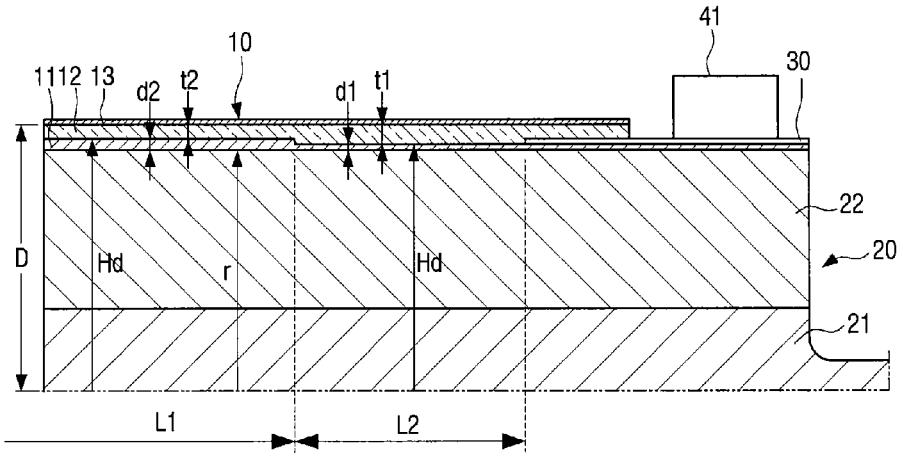
FIG. 5 is a partially enlarged sectional view illustrating the portion of the image fusing apparatus of FIG. 3 illustrated in rectangular A.

FIG. 2 is a perspective view illustrating an image fusing apparatus according to an embodiment of the present disclosure, and FIG. 3 is a front view illustrating the image fusing apparatus of FIG. 2. FIG. 4 is a sectional view illustrating the image fusing apparatus taken along a line 4-4 in FIG. 3, and FIG. 5 is a partially enlarged sectional view illustrating the portion of the image fusing apparatus of FIG. 3 illustrated in rectangular A.

Referring to FIGS. 2 to 5, an image fusing apparatus 1 according to an embodiment may include a heating belt 10, a heating supporting roller 20, an electricity supplying member 30, and a pressing roller 50.

The heating belt 10 generates heat that can heat a printing medium P passing through the image fusing apparatus 1 and includes a resistance heating layer 12 that can uniformly generate heat from the entire surface thereof. The resistance heating layer 12 may be formed in a hollow cylindrical shape. An insulating layer 11 that blocks electricity from flowing into the heating supporting roller 20 inside the resistance heating layer 12 is formed on an inner surface of the resistance heating layer 12. A release layer 13 that allows the printing medium P to be easily separated from the resistance heating layer 12 is formed on an outer surface of the resistance heating layer 12. Accordingly, the heating belt 10 is formed in a laminated structure which the insulating layer 11, the resistance heating layer 12, and the release layer 13 are in sequence stacked.

An aspect of one or more embodiments is to prevent temperature of an area of the heating belt 10 with which the printing medium P is not in contact during printing, (that is, a paper non-contact area of the heating belt 10 from increasing higher than temperature of an area of the heating belt 10 with which the printing medium P is in contact, that is, a paper contact area of the heating belt 10). A paper non-contact area of the heating belt 10 may also be referred to as a non-contact area of the heating belt 10. A paper contact area of the heating belt 10 may also be referred to as a contact area of the heating belt 10. For this, the heating belt 10 is formed so that electrical resistance of the paper non-contact area is smaller than electrical resistance of the paper contact area.

In an embodiment illustrated in FIGS. 3, 4 and 5, in order to make the electrical resistance of the paper non-contact area of the heating belt 10 smaller than the electrical resistance of the paper contact area of the heating belt 10, the resistance heating layer 12 of opposite side end portions L2 and L3 of the heating belt 10, the paper non-contact area of the heating belt 10, is formed to have a thickness thicker than that of a middle portion L1 of the heating belt 10, the paper contact area of the heating belt 10. This is explained in detail hereinafter.

The resistance heating layer 12 may be formed to include carbon nano-tubes. For example, the resistance heating layer 12 may be formed to disperse carbon nano-tubes on which metal is doped as conductive filler into silicone rubber or polyamide which is elastomers.

The heating supporting roller 20 is disposed (positioned) inside the heating belt 10 and is a heating supporting member that supports the heating belt 10 to rotate. The heating supporting roller 20 can rotate with the heating belt 10. Accordingly, slip is not generated between the heating supporting roller 20 and the heating belt 10. The heating supporting roller 20 supports the heating belt 10 and may include an elastic layer 22 formed in a cylindrical shape and a center shaft 21 disposed in the center of the elastic layer 22. The elastic layer 22 may be formed of an elastic material having elasticity such as rubber, sponge, etc. The center shaft 21 is a rigid rotation shaft that supports the heating supporting roller 20 to rotate.

The pressing roller 50 applies a predetermined pressure to a printing medium P passing through the image fusing apparatus 1. The pressing roller 50 is disposed parallel to the heating supporting roller 20 and contacts with the outer surface of the heating belt 10 to form a nip N. The pressing roller 50 may include a rotation shaft 51 and an elastic layer 52 disposed coaxially on the rotation shaft 51. Accordingly, since the printing medium P passing through the nip N between the pressing roller 50 and the heating belt 10 receives heat and pressure, an infused developer image is fused on the printing medium P.

A rotation driving source (not illustrated) is connected to at least one of the heating supporting roller 20 and the pressing roller 50. Accordingly, when one roller 20 or 50 connected to the rotation driving source between the heating supporting roller 20 and the pressing roller 50 is rotated by the rotation driving source, the other roller 50 or 20 also receives the rotation force and then rotates.

The electricity supplying member 30 serves as an electrode to supply electricity to the resistance heating layer 12 of the heating belt 10, and is disposed on circumferential surfaces of opposite side end portions of the heating belt 10. Accordingly, some area of the top surface of the electricity supplying member 30 is overlapped with one side end portion of the resistance heating layer 12 of the heating belt 10 and the other area of the top surface thereof is exposed. Further, the bottom surface of the electricity supplying member 30, that is, a surface that contacts with the heating supporting roller 20, is covered by the insulating layer 11. A brush 41 is disposed in contact with the other area of the electricity supplying member 30 that is not in contact with the resistance heating layer 12 of the heating belt 10. The brush 41 is disposed perpendicular to the center shaft 21 of the heating supporting roller 20 and pressurized by the elastic member 42 such as a spring in order to maintain contact with the electricity supplying member 30 by a predetermined pressure. The brush 41 may be manufactured from carbon. The brush 41 and the elastic member 42 constitute a brush assembly 40. The brush assembly 40 is connected to an electric power source (not illustrated) of an image forming apparatus, and then, supplies electricity to the electricity supplying member 30. When electricity is applied to the brushes 41 of the opposite side ends of the heating supporting roller 20, current flows due to voltage difference between the opposite side ends of the resistance heating layer 12 so as to heat the resistance heating layer 12. The heating belt 10 may be controlled at a proper temperature by a temperature sensor (not illustrated) and a control portion (not illustrated).

In one or more embodiments, in order to prevent temperatures of the areas of the opposite side end portions of the heating belt 10 in non-contact with the printing medium P, that is, the paper non-contact area L2 and L3 from rapidly increasing so as to damage the reliability and stability of the image fusing apparatus 1, the thickness of the heating belt 10, specifically the thickness of the resistance heating layer 12 is formed to change along the lengthwise direction of the heating supporting roller 20. In other words, the resistance heating layer 12 of the middle portion of the heating belt 10 that is in contact with the printing medium P and discharges heat, that is, the paper contact area L1, is formed to have a thickness thinner than that of the resistance heating layer 12 of the opposite side end portions of the heating belt 10 in non-contact with the printing medium P, that is, the paper non-contact areas L2 and L3.

If the thickness t1 of the paper non-contact areas L2 and L3 of the opposite side end portions is thicker than the thickness t2 of the paper contact area L1 of the middle portion, the electrical resistance of the resistance heating layer 12 of the heating belt 10 is decreased, and then, heating temperature of the heating belt 10 is lowered. Therefore, during printing heat is not accumulated in the opposite side end portions L2 and L3 of the heating belt 10.

Here, the width of the paper contact area L1 of the resistance heating layer 12 refers to the width W of the maximum size printing medium P that the resistance heating layer 12 can fuse.

When the thickness of the resistance heating layer 12 changes along the lengthwise direction of the heating supporting roller 20, in terms of a manufacturing process, the resistance heating layer 12 may be formed so that an outer diameter D of the resistance heating layer 12 is constantly maintained across the full length thereof and an inner diameter Hd thereof changes. At this time, the thickness t1 of the paper non-contact areas L2 and L3 of the resistance heating layer 12 may be formed once to three times of the thickness t2 of the paper contact area L1. In order to change the inner diameter Hd of the resistance heating layer 12 formed on the heating supporting roller 20, the thickness of the insulating layer 11 of the heating belt 10 may be changed or the outer diameter r of the heating supporting roller 20 may be changed.

As illustrated in FIG. 5, if the thickness of the resistance heating layer 12 in the paper non-contact area L2 refers to t1 and the thickness of the resistance heating layer 12 in the paper contact area L1 refers to t2, thickness ratio a of the resistance heating layer 12 may be defined as a=t1/t2.

Figure 6:
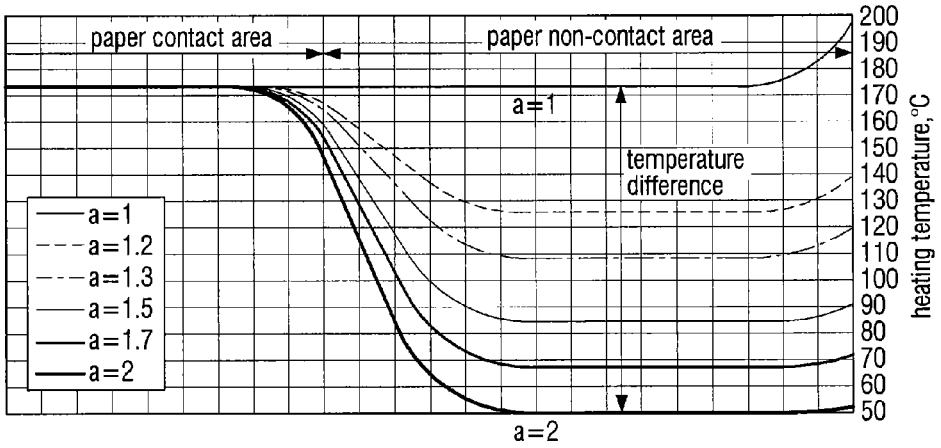
FIG. 6 is a graph illustrating temperature distributions in a paper contact area and a paper non-contact area according to change of thickness ratio of a resistance heating layer
Figure 7:
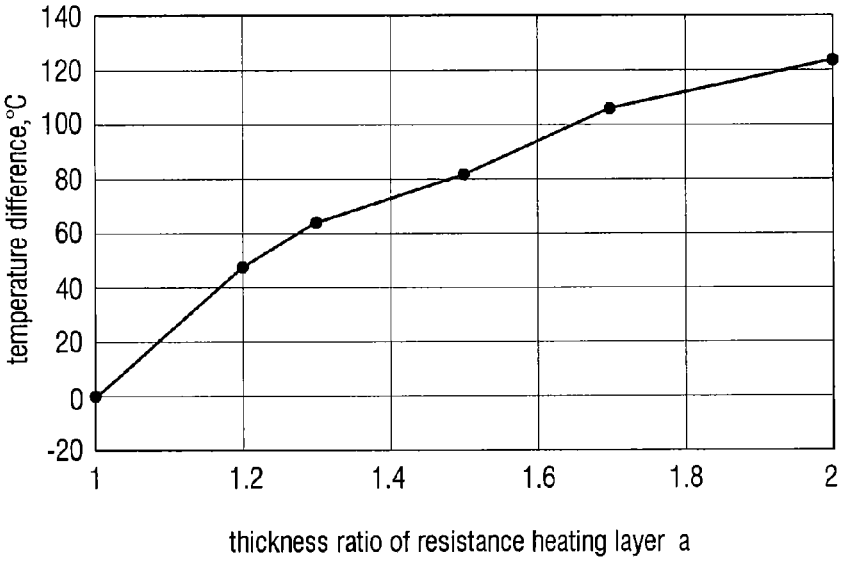
FIG. 7 is a graph illustrating changes of temperature difference between a paper contact area and a paper non-contact area according to changes of thickness ratio of a resistance heating layer.

When a voltage is applied to the electricity supplying member 30 of the heating belt 10, computer simulation results of joule heat generated in the paper contact area L1 and the paper non-contact area L2 of the resistance heating layer 12 are illustrated in FIGS. 6 and 7.

Referring to FIG. 6, it is found that increasing the thickness ratio a of the resistance heating layer 12 allows temperature of the paper non-contact areas L2 and L3 to be decreased. Further, referring to FIG. 7, it is found that increasing the thickness ratio a of the resistance heating layer 12 allows temperature difference between the paper non-contact areas L2 and L3 and the paper contact area L1 to be increased.

Figure 8:
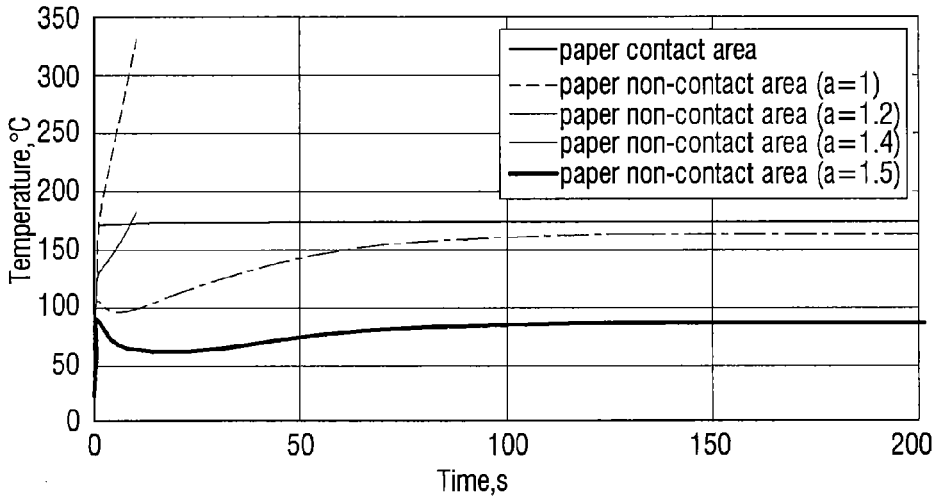
FIG. 8 is a graph illustrating simulation of heating status in a paper contact area and a paper non-contact area according to changes of thickness ratio of a resistance heating layer.

When the image fusing apparatus 1 is initially heated and then maintained in a certain control temperature, FIG. 8 illustrates a computer simulation result of affection of the passing printing medium P in the paper contact area L1 and the paper non-contact areas L2 and L3 depending on the change of the thickness ratio a of the resistance heating layer 12.

Referring to FIG. 8, if the thickness t2 of the paper contact area L1 is the same as the thickness t1 of the paper non-contact areas L2 and L3 (namely, a=1), temperature of the paper non-contact areas L2 and L3 continues to be increased above a control temperature. If the thickness t1 of the paper non-contact areas L2 and L3 is thicker than the thickness t2 of the paper contact area L1, degree of temperature rise is decreased. If the thickness ratio a of the resistance heating layer 12 is larger than 1.4 (namely, a 1.4), the temperature of the paper non-contact areas L2 and L3 is maintained below the control temperature.

Referring to FIG. 5, it is found that the thickness t1 of a portion of the resistance heating layer 12 corresponding to the paper non-contact areas L2 and L3 is thicker than the thickness t2 of a portion of the resistance heating layer 12 corresponding to the paper contact area L1.

The resistance heating layer 12 having thickness that is changed in the lengthwise direction of the heating supporting roller 20 may be formed as described below.

The insulating layer 11 that has thickness changed along the lengthwise direction of the heating supporting roller 20 is formed on the outer surface of the heating supporting roller 20 that has the same outer diameters across full-length thereof. In other words, the insulating layer 11 that is disposed between the resistance heating layer 12 and the heating supporting roller 20 is formed to have a diameter Hd complementarily changed depending on the thickness change across the full-length of the resistance heating layer 12. In other words, the thickness d1 of a portion of the insulating layer 11 corresponding to the paper non-contact areas L2 and L3 is formed to be thinner than the thickness d2 of a portion of the insulating layer 11 corresponding to the paper contact area L1. At this time, the thickness difference d2−d1 of the insulating layer 11 is the same as the thickness difference t1−t2 of the resistance heating layer 12. The insulating layer 11 is formed so that d2−d1=t1−t2. After that, the resistance heating layer 12 is stacked on the insulating layer 11 and then is machined to have a desired size of an outer diameter D so as to obtain the heating belt 10 having the paper contact area L1 the thickness t2 of which is thinner than the thickness t1 of the paper non-contact areas L2 and L3. At this time, the heating belt 10 is formed so that the inner diameter of the resistance heating layer 12 and the outer diameter of the insulating layer 11 have the same size across the full-length of the heating supporting roller 20.

Figure 9:
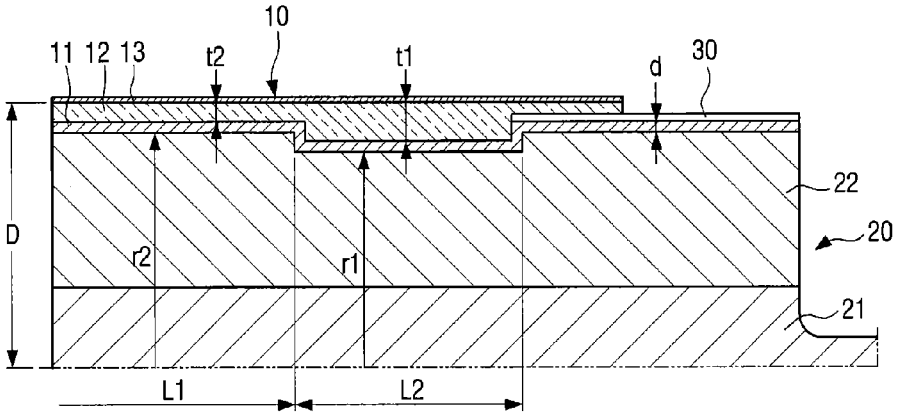
FIG. 9 is a partially enlarged sectional view illustrating a heating supporting roller having an outer diameter changed in order to change a thickness of a resistance heating layer.

In a method of an embodiment, the resistance heating layer 12 the thickness of which is changed in the lengthwise direction of the heating supporting roller 20 may be formed as described below. First, the outer diameter r of the heating supporting roller 20 is formed to have steps changed to correspond to the thickness change of the resistance heating layer 12. As illustrated in FIG. 9, the heating supporting roller 20 is formed so that the radius r1 of a portion of the heating supporting roller 20 corresponding to the paper non-contact areas L2 and L3 is smaller than the radius r2 of a portion of the heating supporting roller 20 corresponding to the paper contact area L1. At this time, the radius difference r2−r1 of the heating supporting roller 20 is the same as the thickness difference t1−t2 of the resistance heating layer 12. In other words, the heating supporting roller 20 is formed so that r2−r1=t1−t2. After that, the insulating layer 11 is formed to have a uniform thickness d on the outer surface of the heating supporting roller 20. Then, the resistance heating layer 12 is laminated on the insulating layer 11 to have a predetermined height, and then, is machined to have a desired size of an outer diameter D so as to obtain the heating belt 10 having the thickness changed in the lengthwise direction thereof. In other words, the heating belt 10 having thickness t2 of the resistance heating layer 12 of the paper contact area L1 thinner than the thickness t1 of the resistance heating layer 12 of the paper non-contact areas L2 and L3 may be obtained.

Hereinafter, in order to lower temperature of the paper non-contact areas L2 and L3 below temperature of the paper contact area L1, a method using a pattern shape of an area on which the electricity supplying member 30 and the resistance heating layer 12 are in contact with each other will be explained instead of the above-described method to change the thickness in the lengthwise direction of the resistance heating layer 12 of the heating belt 10.

This method reduces the area of the contacting portion where the electricity supplying member 30 and the resistance heating layer 12 are in contact with each other so as to lower the temperature of the paper non-contact areas L2 and L3 below the temperature of the paper contact area L1.

FIGS. 10, 11 and 12A-12C illustrate an example of the heating belt 10 to which the method for reducing the area of the contacting portion between an electricity supplying member 60 and the resistance heating layer 12 of the heating belt 10 is applied.

Figure 10:
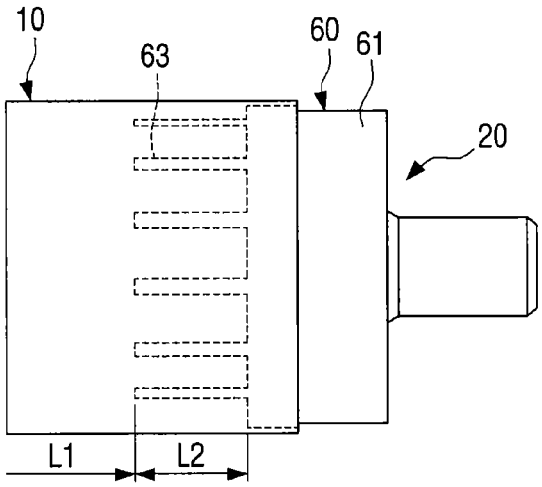
FIG. 10 is a partially perspective view illustrating an example of a heating supporting roller that can lower temperature of a paper non-contact area of a heating belt by an electricity supplying member in an image fusing apparatus according to an embodiment.
Figure 11:
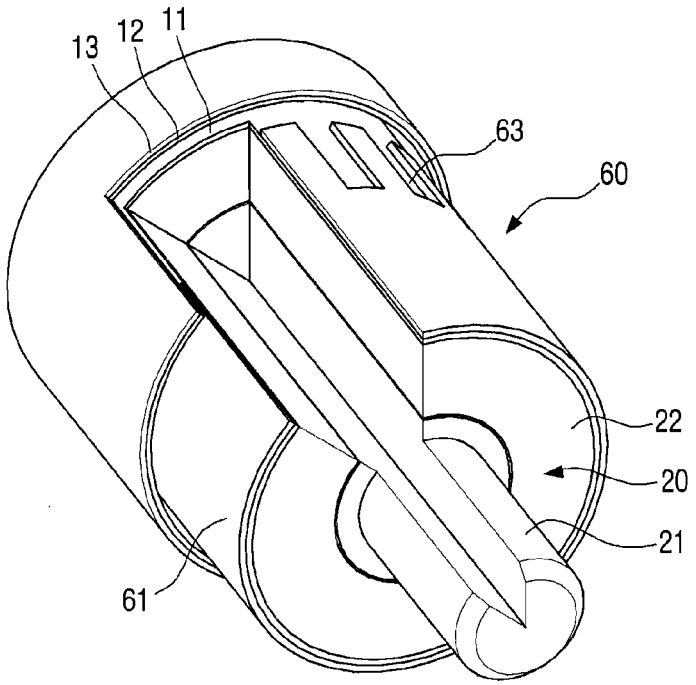
FIG. 11 is a partially cutaway view illustrating the heating supporting roller of FIG. 10.
Figure 12A:
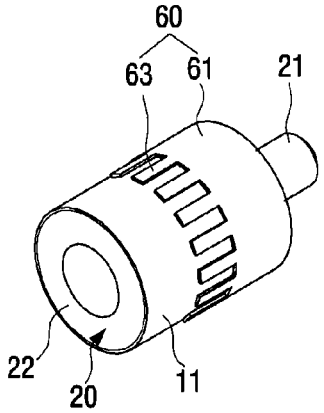
FIGS. 12A-12C are perspective views illustrating a manufacturing process of the heating supporting roller of FIG. 10.
Figure 12B:
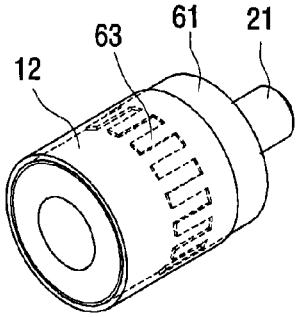
Figure 12C:
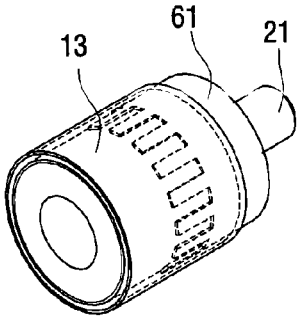

FIG. 10 is a partially perspective view illustrating an example of the heating supporting roller 20 on which the heating belt 10 that can lower temperature of the paper non-contact area L2 thereof by using the electricity supplying member 60 is disposed in an image fusing apparatus 1 according to an embodiment, and FIG. 11 is a partially cutaway view illustrating the heating belt 10 and the heating supporting roller 20 of FIG. 10. FIGS. 12A-12C are perspective views illustrating a process manufacturing the heating belt 10 of FIG. 10.

Referring to FIGS. 10, 11, and 12A-12C, the electricity supplying member 60 and the resistance heating layer 12 are electrically connected with each other through a plurality of contacting portions formed in a predetermined shape in a circumferential direction of the heating belt 10. In other words, the plurality of contacting portions may be formed in band shapes separated by a regular interval in the circumferential direction of the heating belt 10.

Figure 13:
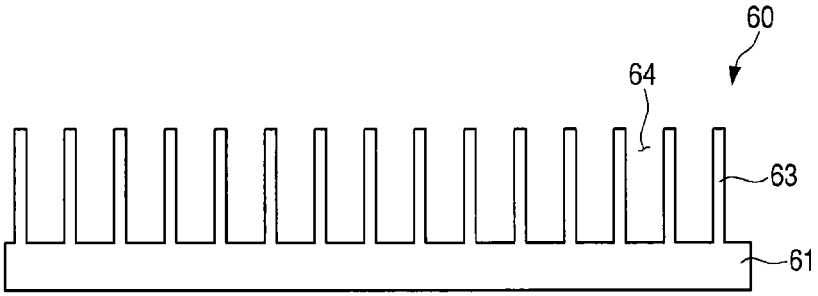
FIG. 13 is a view illustrating an example of the electricity supplying member of FIG. 10.

The electricity supplying member 60 includes a body portion 61 disposed on an end of the heating supporting roller 20 and a plurality of projecting portions 63 that project from the body portion 61 by a regular interval. Each of the plurality of projecting portions 63 is formed to have a length corresponding to the width of the paper non-contact area L2 and a predetermined width. The plurality of projecting portions 63, as illustrated in FIG. 13, may be formed to project vertically from the body portion 61 Accordingly, if the electricity supplying member 60 is disposed on the heating supporting roller 20, the plurality of projecting portions 63 are parallel to the center shaft 21 of the heating supporting roller 20. However, in this case, portions of the heating belt 10 corresponding to spaces 64 among the plurality of projecting portions 63 may have too low temperatures.

Figure 14:
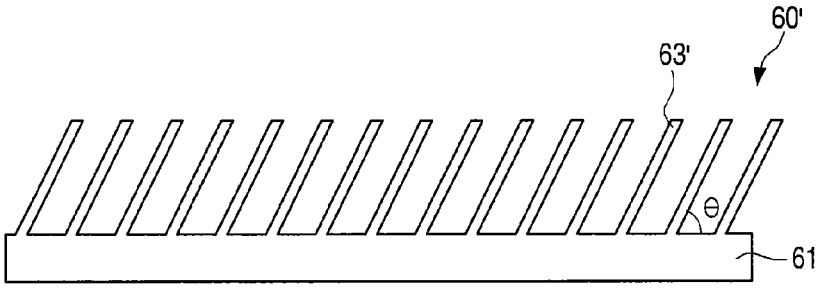
FIG. 14 is a view illustrating an example of the electricity supplying member of FIG. 10.

For preventing this, the plurality of projecting portions 63 may be formed to be inclined to the center shaft 21 of the heating supporting roller 20. FIG. 14 illustrates an electricity supplying member 60' having a plurality of projecting portions 63' inclined at a predetermined angle θ with respect to the body portion 61. If the electricity supplying member 60' as illustrated in FIG. 14 is disposed on the heating supporting roller 20, there are no portions on which the electricity supplying member 60' does not exist in the lengthwise direction of the heating supporting roller 20. Therefore, the temperature of the paper non-contact area L2 can be prevented from lowering too much.

The heating belt 10 having the electricity supplying member 60 and 60' as described above may be formed by a method as described below. First, as illustrated in FIG. 12A, the insulating layer 11 configuring the heating belt 10 is formed on the top surface of the heating supporting roller 20 and the electricity supplying member 60 having a plurality of projecting portions 63 is disposed on a top surface of the insulating layer 11. As illustrated in FIG. 12B, the resistance heating layer 12 is formed on the insulating layer 11 and the electricity supplying member 60. As a result, some portion of the resistance heating layer 12 is in contact with the plurality of projecting portions 63 and some portion of the body portion 61 of the electricity supplying member 60, and the other portion of the resistance heating layer 12 is disposed on the insulating layer 11. Accordingly, the plurality of projecting portions 63 of the electricity supplying member 60 forms contacting portions that allows the electricity supplying member 60 to be in contact with and to be electrically connected with the resistance heating layer 12. After that, as illustrated in FIG. 12C, a release layer 13 is formed on the resistance heating layer 12. As a result, the heating belt 10 temperature of the paper non-contact area L2 of which can be lowered by the shape of the contacting portion between the electricity supplying member 60 and the resistance heating layer 12 is formed.

FIGS. 15, 16 and 17A-17D illustrate an example of the heating belt 10 which can reduce the area of the contacting portion between an electricity supplying member 70 and the resistance heating layer 12.

Figure 15:
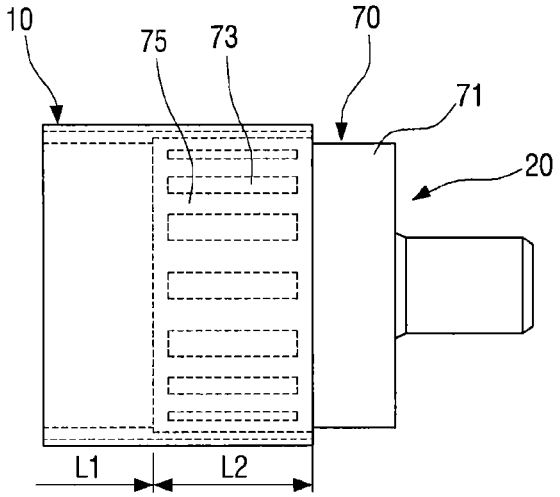
FIG. 15 is a partially perspective view illustrating an example of a heating supporting roller that can lower temperature of a paper non-contact area of a heating belt by an electricity supplying member in an image fusing apparatus according to an embodiment.
Figure 16:
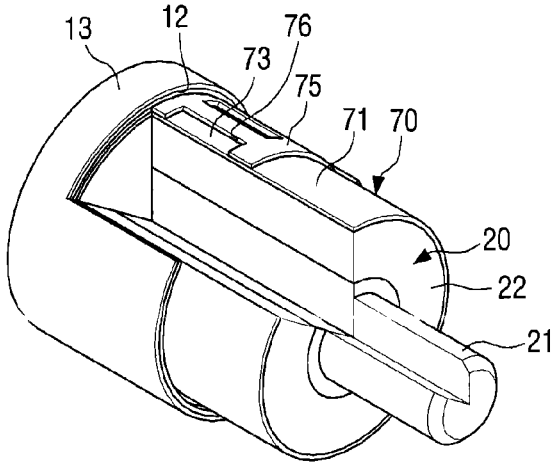
FIG. 16 is a partially cutaway view illustrating the heating supporting roller of FIG. 15.

FIG. 15 is a partially perspective view illustrating the heating supporting roller 20 on which an example of a heating belt 10 that can lower temperature of the paper non-contact area L2 thereof by using an electricity supplying member 70 is disposed in an image fusing apparatus 1 according to an embodiment, and FIG. 16 is a partially cutaway view illustrating the heating belt 10 and the heating supporting roller 20 of FIG. 15. FIGS. 17A-17D are perspective views illustrating a process manufacturing the heating belt 10 of FIG. 15.

Referring to FIGS. 15, 16, and 17A-17D, the electricity supplying member 70 and the resistance heating layer 12 are electrically connected with each other through a plurality of contacting portions formed in a predetermined shape in a circumferential direction of the heating belt 10. In other words, the plurality of contacting portions may be formed in band shapes separated at a regular interval in the circumferential direction of the heating belt 10.

The electricity supplying member 70 includes a body portion 71 disposed on an end of the heating supporting roller 20 and an extending portion 73 that extends from the body portion 71 to correspond to the paper non-contact area of the heating belt 10. An electrode insulating layer 75 to configure the contacting portions is formed on the top surface of the extending portion 73.

In order words, the electrode insulating layer 75 is disposed between the extending portion 73 of the electricity supplying member 70 and the resistance heating layer 12. A plurality of through holes 76 having a predetermined shape are formed on the electrode insulating layer 75 in the circumferential direction of the heating supporting roller 20. Accordingly, the resistance heating layer 12 and the electricity supplying member 70 are electrically connected with each other by a material that forms the resistance heating layer 12 and fills up the plurality of through holes 76 of the electrode insulating layer 75. At this time, the plurality of through holes 76 of the electrode insulating layer 75 may be formed a slot shape having a length corresponding to the width of the paper non-contact area L2 and a predetermined width. As a result, each of the contacting portions where the electricity supplying member 70 is in contact with the resistance heating layer 12 forms substantially a band shape.

Figure 17A:
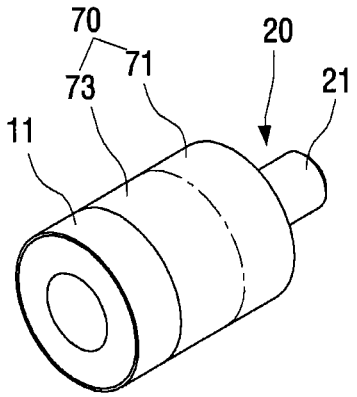
FIGS. 17A-17D are perspective views illustrating a manufacturing process of the heating supporting roller of FIG. 15.
Figure 17B:
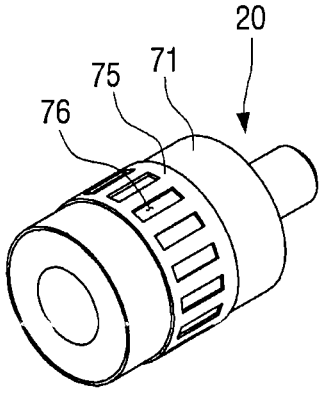
Figure 17C:
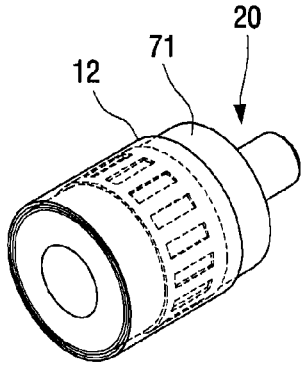
Figure 17D:
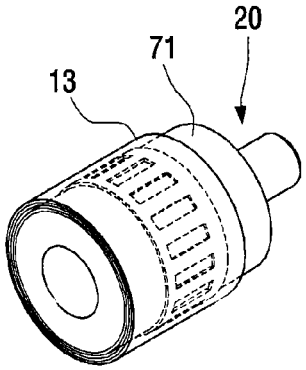

The heating belt 10 having the contacting portions as described above may be formed by a method as described below. First, the insulating layer 11 configuring the heating belt 10 is formed on the top surface of the heating supporting roller 20, and as illustrated in FIG. 17A, the electricity supplying member 70 having the extending portion 73 is disposed on the insulating layer 11. Next, as illustrated in FIG. 17B, the electrode insulating layer 75 having the plurality of through holes 76 is formed on the top surface of the extending portion 73 of the electricity supplying member 70. After that, as illustrated in FIG. 17C, the resistance heating layer 12 is formed on the top surfaces of the insulating layer 11 and the electrode insulating layer 75. As a result, since the material configuring the resistance heating layer 12 is filled in the plurality of through holes 76 of the electrode insulating layer 75, the resistance heating layer 12 and the electricity supplying member 70 form the plurality of contacting portions having a shape corresponding to a cross-section of each of the plurality of through holes 76. Finally, as illustrated in FIG. 17D, the release layer 13 is formed on the top surface of the resistance heating layer 12. As a result, the heating belt 10 temperature of the paper non-contact area L2 of which can be lowered by reducing the area of the contacting portion between the electricity supplying member 70 and the resistance heating layer 12 is formed.

In the above explanation, as the method for lowering temperature of the paper non-contact area L2 of the image fusing apparatus 1, in order to make the electrical resistance of the paper non-contact area L2 smaller than that of the paper contact area L1, the method changing the thickness of the resistance heating layer 12 or the method changing the shape of the contacting portion between the electricity supplying member 60 and 70 and the resistance heating layer 12 is individually applied to the image fusing apparatus 1. However, although not illustrated, in order to lower the temperature of the paper non-contact area L2, the above described two methods may be applied to manufacture the image fusing apparatus 1 at the same time.

Since the image fusing apparatus 1 according to an embodiment having the above-described structure uses the resistance heating belt 10 having a low thermal capacity, temperature rising time is short, energy saving effect is large, and excellent heating uniformity can be obtained. Further, the image fusing apparatus 1 according to an embodiment is formed to have a structure in that the heating belt 10 is rotated with the heating supporting roller 20 to avoid slip. Accordingly, since lubricant such as grease does not need to be used, contamination problems can be solved, and damage of the heating belt 10 by the friction force can be prevented. Specially, since the image fusing apparatus 1 according to an embodiment is configured so that heat is not accumulated in the paper non-contact areas L2 and L3 of the heating belt 10, during continuous printing, overheating of the image fusing apparatus 1 can be avoided.

In the above explanation, the heating belt 10 is rotatably supported by the heating supporting roller 20 having the elastic layer 22. However, one or more embodiments can be applied to image fusing apparatuses 2 and 3 of FIGS. 18 and 19 having the heating belt 10 formed on a heating supporting roller 20' and 20" having no elastic layer 22.

Figure 18:
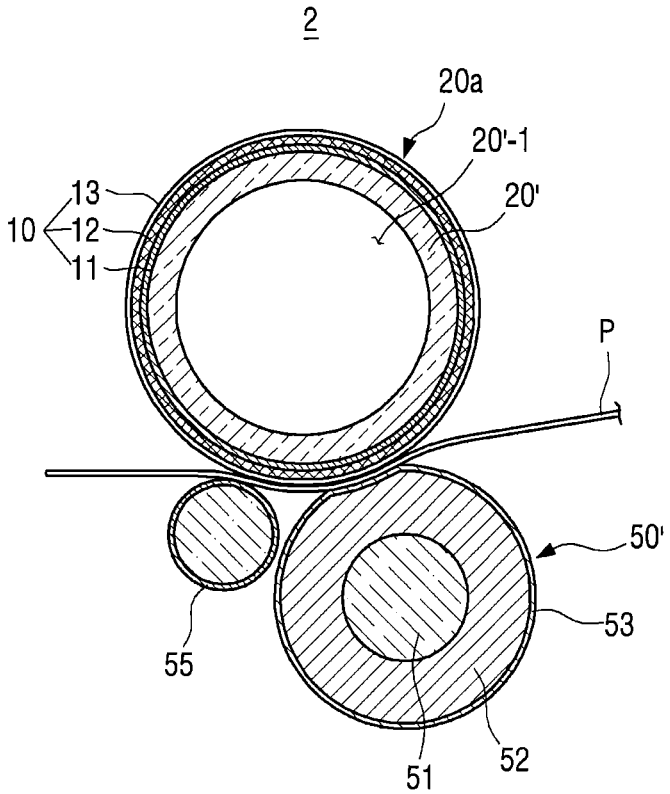
FIGS. 18, 19 and 20 are sectional views schematically illustrating image fusing apparatuses according to an embodiment.
Figure 19:
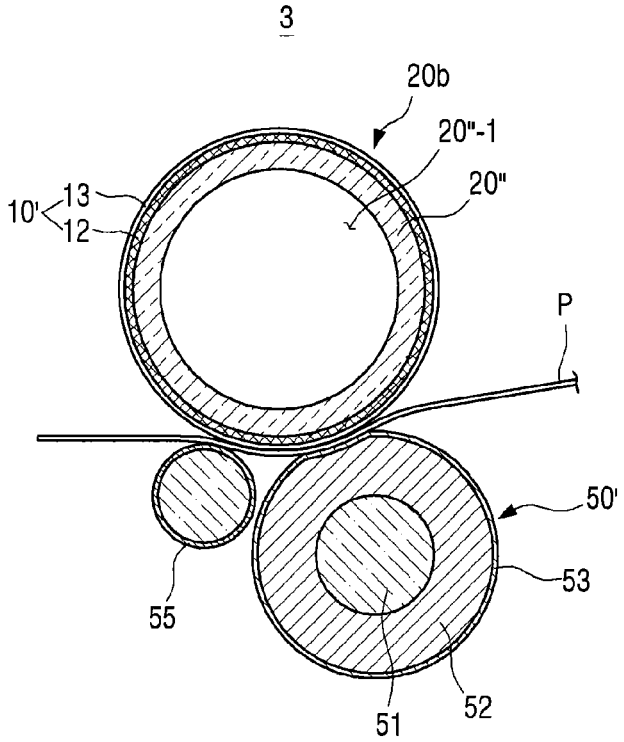

FIGS. 18 and 19 are sectional views schematically illustrating image fusing apparatuses 2 and 3 including a heating roller 20*a* and 20*b* having the heating belt 10 and 10' formed on the heating supporting roller 20' and 20" having no elastic layer 22.

In FIG. 18, the heating supporting roller 20' is formed in a cylindrical shape having a hollow 20'-1. A pair of supporting shafts is formed on opposite ends of the hollow cylinder 20' to allow the hollow cylinder 20' to rotate. The hollow cylinder 20' and the pair of supporting shafts are formed of a conductive rigid material, for example, a metal. Accordingly, the insulating layer 11 is formed on the surface of the hollow cylinder 20', and the resistance heating layer 12 and the release layer 13 are in sequence laminated on the top surface of the insulating layer 11 so as to form the heating roller 20*a*. At this time, since the heating supporting roller 20' is a rigid member difficult to form a nip, the pressing roller 50' needs to have an elastic layer 52. In other words, the pressing roller 50' has a structure in that an elastic layer 52 and a release layer 53 are laminated on a center shaft 51 having rigidity. If the nip formed by the structure is small, an auxiliary pressing roller 55 may additionally be disposed.

Although the heating supporting roller 20' is formed of the rigid material, the temperature of the paper non-contact area can be prevented from increasing by adjusting the thickness of the lengthwise direction of the resistance heating layer 12 or reducing the area of the contacting portion with the electricity supplying member 60 and 70 as described above. The method for adjusting the thickness of the resistance heating layer 12 and the method for reducing the area of the contacting portion with the electricity supplying member 60 and 70 are described in detail above. Therefore, detailed descriptions thereof will be omitted.

FIG. 19 illustrates a heating supporting roller 20" formed in a cylindrical shape having a hollow 20"-1 similar to FIG. 18. The hollow cylinder 20" is formed of a non-conductive rigid material. In other words, the heating supporting roller 20" as illustrated in FIG. 19 has not the elastic layer 22 formed on the center shaft 21 of the heating supporting roller 20 as illustrated in FIGS. 2, 3 and 4. A center shaft 20" is formed as a non-conductive hollow cylinder. Although not illustrated, the center shaft 20" may be formed as a non-conductive solid shaft having no hollow 20"-1. Therefore, the insulating layer 11 is not formed on the surface of the hollow cylinder 20". The resistance heating layer 12 is directly formed on the surface of the hollow cylinder 20" and the release layer 13 is formed on the resistance heating layer 12 so as to form the heating roller 20*b*. At this time, since the heating supporting roller 20" is a rigid member difficult to form a nip, the pressing roller 50' needs to have an elastic layer 52. In other words, the pressing roller 50' has a structure in that an elastic layer 52 and a release layer 53 are laminated on a center shaft 51 having rigidity. If the nip formed by the pressing roller 50" is small, an auxiliary pressing roller 55 may additionally be disposed to increase the nip area.

Although the heating supporting roller 20" is formed of the rigid material, the temperature of the paper non-contact area can be prevented from increasing by adjusting the thickness of the lengthwise direction of the resistance heating layer 12 or reducing the area of the contacting portion with the electricity supplying member 60 and 70 as described above. The method for adjusting the thickness of the resistance heating layer 12 and the method for reducing the area of the contacting portion with the electricity supplying member 60 and 70 are described in detail above. Therefore, detailed descriptions thereof will be omitted.

Figure 20:
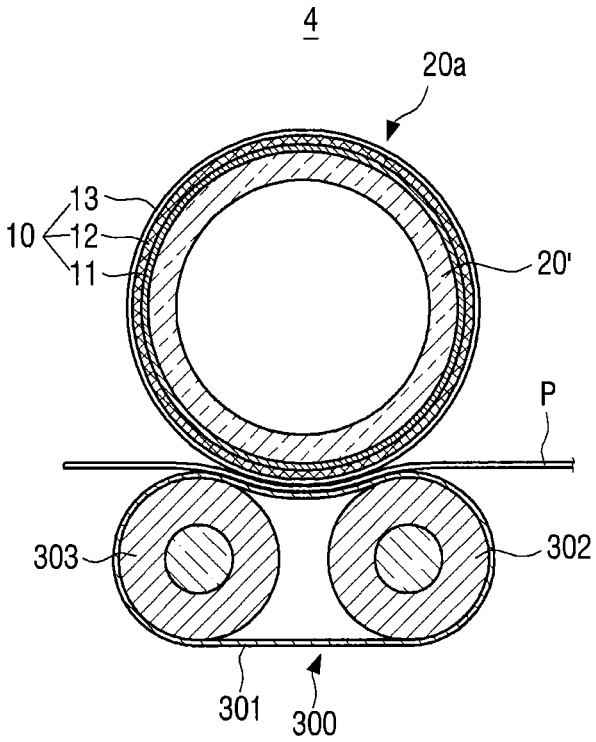

FIG. 20 is a sectional view schematically illustrating an image fusing apparatus 4 using a pressing belt assembly 300 instead of the pressing roller 50' of the image fusing apparatus 2 as illustrated in FIG. 18.

In this case, a pressing belt 301 supported by a pair of supporting rollers 302 and 303 to move endlessly in a closed loop can form a sufficient nip with the heating roller 20*a* having rigidity. In an embodiment, also the temperature of the paper non-contact area can be prevented from increasing by adjusting the thickness of the lengthwise direction of the resistance heating layer 12 of the heating belt 10 or reducing the area of the contacting portion with the electricity supplying member 60 and 70 as described above. The method for adjusting the thickness of the resistance heating layer 12 and the method for reducing the area of the contacting portion with the electricity supplying member 60 and 70 are described in detail above. Therefore, detailed descriptions thereof will be omitted.

In the above description, electricity is supplied by the brush 41 disposed perpendicular to the axial direction of the heating supporting roller 20 to be in contact with the electricity supplying members disposed on the opposite side end portions of the outer circumferential surface of the heating supporting roller 20'. In an embodiment, electricity can be supplied by a brush disposed on the heating supporting roller 20 in the axial direction thereof.

Referring to FIGS. 2 and 3, the electricity supplying member 30 is disposed on the outer circumferential surface of the heating supporting roller 20 and the brush 41 is disposed perpendicular to the center shaft 21 of the heating supporting roller 20 so as to supply with electricity. However, as an embodiment, the brush may be disposed in the axial direction of the heating supporting roller 20 to supply with electricity. This structure will be described with reference to FIGS. 21 and 22.

Figure 21:
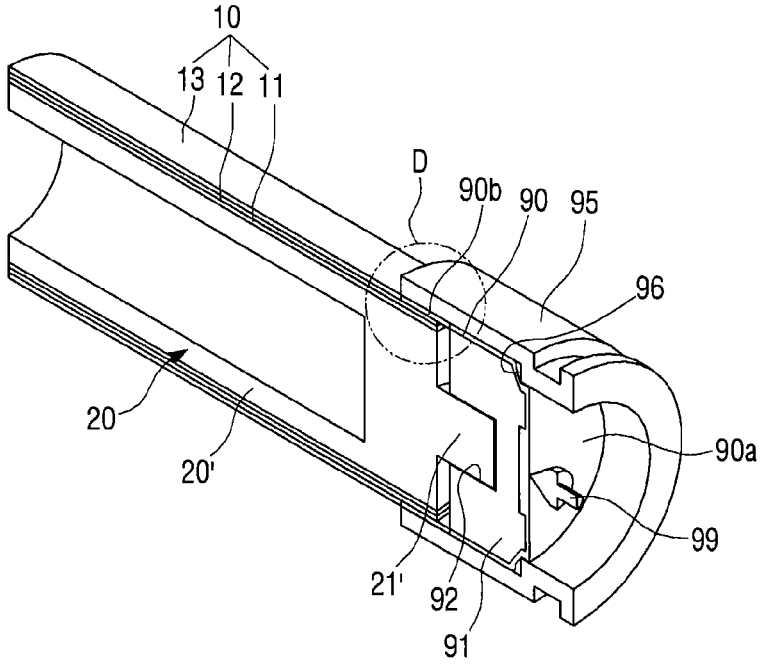
FIG. 21 is a sectional perspective view illustrating a cap type electricity supplying member disposed on a heating supporting roller.
Figure 22:
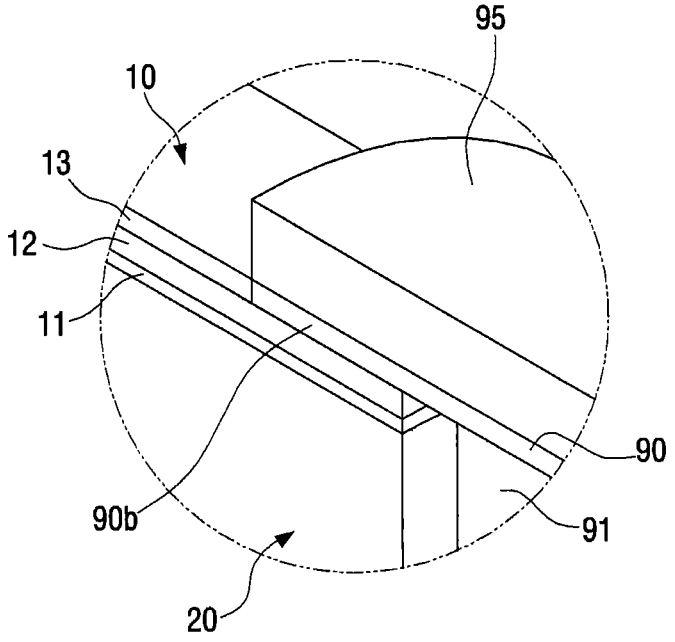
FIG. 22 is a partially enlarged perspective view illustrating the portion of the heating supporting roller of FIG. 21 illustrated in circle D.

FIG. 21 is a sectional perspective view illustrating a cap type electricity supplying member 90 disposed on the heating supporting roller 20, and FIG. 22 is a partially enlarged perspective view illustrating the portion of the heating supporting roller 20 of FIG. 21 illustrated in circle D;

Referring to FIG. 21, the electricity supplying member 90 is formed in a cap shape wrapping one end of the heating supporting roller 20. In other words, the cap type electricity supplying member 90 is formed in a cylindrical container that can be inserted into the one end of the cylindrical heating supporting roller 20. Accordingly, the electricity supplying member 90 is disposed to be inserted in the one end of the heating supporting roller 20. At this time, the heating supporting roller 20 may be formed to include a hollow cylinder portion 20' and a pair of supporting shafts 21' projecting from the opposite ends of the hollow cylinder 20'.

The cap type electricity supplying member 90 can be supplied with electricity by the brush 99 disposed to contact with the cap type electricity supplying member 90 in the axial direction of the heating supporting roller 20. In other words, the brush 99 elastically supported by a spring in the axial direction of the heating supporting roller 20 is disposed to be in contact with a bottom surface 90 a of the cap type electricity supplying member 90. Accordingly, even when the heating supporting roller 20 rotates, the electricity supplying member 90 can be supplied with electricity by the brush 99. At this time, the brush 99 may be formed of a carbon.

In addition, the above-described cap type electricity supplying member 90 is fixed to the heating supporting roller 20 by an inner supporting cap 91 and an outer fixing cap 95. The inner supporting cap 91 is fixed to the supporting shaft 21' of the heating supporting roller 20 and supports an inner surface of the cap type electricity supplying member 90. Accordingly, the inner supporting cap 91 includes a fixing groove 92 corresponding to the supporting shaft 21' of the heating supporting roller 20. The outer diameter of the inner supporting cap 91 is formed to be inserted inside and support the cap type electricity supplying member 90.

The outer fixing cap 95 supports the outer surface of the cap type electricity supplying member 90 and fixes the cap type electricity supplying member 90 to the resistance heating layer 12 of the heating supporting roller 20. Accordingly, the outer fixing cap 95 is formed in a hollow cylindrical shape, has an inner diameter of the dimension in which the cap type electricity supplying member 90 can be inserted, and has one end on which a stepping portion 96 is formed to fix the cap type electricity supplying member 90.

The cap type electricity supplying member 90 is disposed on the heating supporting roller 20 as described below. First, one end of the supporting shaft 21' of the heating supporting roller 20 is inserted into the fixing groove 92 of the inner supporting cap 91. As a result, the inner supporting cap 91 is fixed to the heating supporting roller 20. After that, the cap type electricity supplying member 90 is inserted into the inner supporting cap 91. Next, the outer fixing cap 95 is inserted into the cap type electricity supplying member 90 so that the cap type electricity supplying member 90 is fixed to the one end of the heating supporting roller 20. At this time, as illustrated in FIG. 22, a top portion 90*b* of the cap type electricity supplying member 90 is in contact with the resistance heating layer 12 formed on the heating supporting roller 20 and fixed by the outer fixing cap 95. Accordingly, the electricity supplied with by the brush 99 in contact with the bottom surface 90*a* of the cap type electricity supplying member 90 is supplied to the resistance heating layer 12 through the cap type electricity supplying member 90.

Although not illustrated, in the same way as described above, the cap type electricity supplying member 90 is fixed to the opposite end of the heating supporting roller 20 as illustrated in FIG. 20 by the inner supporting cap 91 and the outer fixing cap 95. Accordingly, if the outer fixing caps 95 disposed on the opposite ends of the heating supporting roller 20 are rotatably supported, the heating supporting roller 20 can rotate.

In order to make the electrical resistance of the paper non-contact areas L2 and L3 of the heating belt 10' smaller than the electrical resistance of the paper contact area L1, a case in that the paper non-contact areas L2 and L3 is formed to have electrical conductivity higher than that of the paper contact area L1 will be explained hereinafter.

Figure 23:
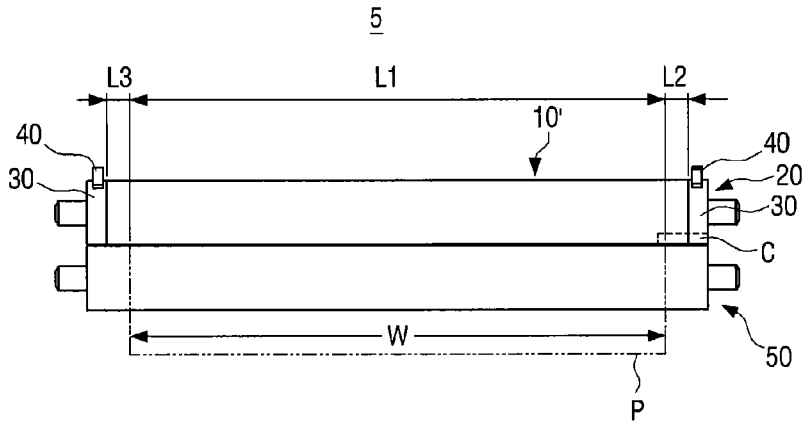
FIG. 23 is a front view illustrating an image fusing apparatus according to an embodiment.
Figure 24:
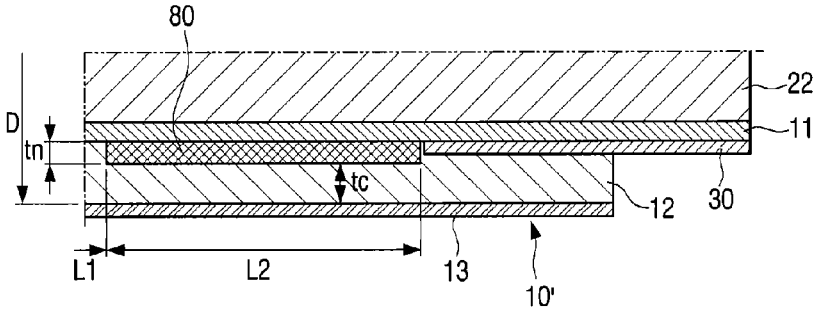
FIG. 24 is a partially enlarged sectional view illustrating the portion of the image fusing apparatus of FIG. 23 illustrated in rectangular C.

FIG. 23 is a front view illustrating an image fusing apparatus 5 according to an embodiment. FIG. 24 is a partially enlarged sectional view illustrating the portion of the image fusing apparatus 5 of FIG. 23 illustrated in rectangular C.

Referring to FIGS. 23 and 24, the image fusing apparatus 5 according to an embodiment may include a heating belt 10', the heating supporting roller 20, the electricity supplying member 30, and the pressing roller 50.

The heating belt 10' generates heat that can heat a printing medium P passing through the image fusing apparatus 5 and includes the resistance heating layer 12 that can uniformly generate heat from the entire surface thereof. The resistance heating layer 12 may be formed in a hollow cylindrical shape. The release layer 13 that allows the printing medium P to be easily separated from is formed on the outer surface of the resistance heating layer 12. \If the surface of the heating supporting roller 20 to be inserted in the heating belt 10' is not insulated; the insulating layer 11 that blocks electricity from flowing into the internal heating supporting roller 20 is formed on the inner surface of the resistance heating layer 12. Accordingly, the heating belt 10' is formed in a laminated structure that the insulating layer 11, the resistance heating layer 12, and the release layer 13 are in sequence laminated. If the surface of the heating supporting roller 20 is insulated, the heating belt 10' may be formed in a two-layer structure that the resistance heating layer 12 and the release layer 13 are in sequence laminated.

An aspect of one or more embodiments is to prevent temperature of an area of the heating belt 10' with which the printing medium P is not in contact during printing, (that is, a paper non-contact area L2 and L3 of the heating belt 10') from rising (increasing) higher than temperature of an area of the heating belt 10' with which the printing medium P is in contact, that is, a paper contact area L1 of the heating belt 10'. For this, the heating belt 10' is formed so that the electric resistance of the paper non-contact area L2 and L3 is smaller than the electric resistance of the paper contact area L1.

In an embodiment as illustrated in FIGS. 23 and 24, in order to make the electrical resistance of the paper non-contact area of the heating belt 10' smaller than the electrical resistance of the paper contact area, the opposite side end portions L2 and L3 of the heating belt 10', the paper non-contact area, are formed to have electrical conductivity higher than that of the middle portion L1 of the heating belt 10', the paper contact area.

For this, in this embodiment, a conductive layer 80 is formed to be electrically connected with the resistance heating layer 12 on a portion corresponding to the paper non-contact area L2 of the heating belt 10'. The conductive layer 80 may be formed of a metal or a conductive resin having electrical conductivity higher than that of the resistance heating layer 12. The conductive layer 80 may be disposed close to or directly contact with the electricity supplying member 30. Further, since electricity can flow through the resistance heating layer 12, the conductive layer 80 may be formed to be separated from the electricity supplying member 30 by the resistance heating layer 12.

If the conductive layer 80 is formed on the insulating layer 11, the resistance heating layer 12 is formed on the conductive layer 80, and the resistance heating layer 12 is machined to have a constant outer diameter D, the heating belt 10' has the structure as illustrated in FIG. 24 in the paper non-contact area L2.

The electrical resistance R of the paper non-contact area L2 is represented as follows.

$$\frac{1}{R} = \frac{1}{Rc} + \frac{1}{Rn} = \frac{b}{Rc} \tag{1}$$

$$\frac{1}{Rn} = \frac{b-1}{Rc}$$

$$Rc = (b-1)Rn$$

where, Rc is the electrical resistance of the resistance heating layer 12, Rn is the electrical resistance of the conductive layer 80, and b is a resistance reduction ratio (or electrical conductivity ratio) to the resistance heating layer 12 when the paper non-contact area L2 is formed of only the conductive layer 80.

Formula 1 is arranged with respect to the electrical conductivity as follows, $$\rho_n = \frac{1}{b-1}\frac{t_n}{t_c}\rho_c \tag{2}$$

$$\sigma_n = (b-1)\frac{t_c}{t_n}\varpi_c$$

$$\lambda = (b-1)\frac{t_c}{t_n}$$

Where $\rho_n$ is resistivity of the conductive layer 80, $\rho_c$ is resistivity of the resistance heating layer 12, $\sigma_n$ is electrical conductivity of the conductive layer 80, $\sigma_c$ is electrical conductivity of the resistance heating layer 12, and $\lambda$ is an electrical conductivity ratio of the conductive layer 80 and the resistance heating layer 12 ($\lambda=\sigma_n/\sigma_c$).

Accordingly, material and thickness of the conductive layer 80 with respect to the resistance reduction ratio b may be determined from Formula 2 and FIG. 24. The conductive layer 80 may be formed of a metal film having thickness of 1 nm~999 μm. Also, the conductive layer 80 may be formed to have the electrical conductivity 1~500 times greater than that of the resistance heating layer 12.

For example, when the electrical conductivity $\sigma_c$ of the resistance heating layer 12 is 330.7 S/m, and the conductive layer 80 is made of Ni ($\sigma_n$=1.56E7 S/m), the thickness $t_n$ of the conductive layer 80 with respect to the resistance reduction ratio b is shown in Table 1.

TABLE 1

| b | $t_n$, μm |
|---|---|
| 2 | 0.00506 |
| 5 | 0.02023 |
| 10 | 0.04552 |
| 50 | 0.24760 |
| 100 | 0.49973 |
| 200 | 1.00240 |

In an embodiment, if the conductive layer 80 is formed of a conductive resin, and the ratio of the conductive layer thickness and the entire thickness is 0.163, the electrical conductivity ratio of the resistance heating layer 12 and the conductive resin is shown in Table 2 below.

TABLE 2

| b | λ |
|---|---|
| 1.5 | 2.914 |
| 2 | 5.829 |
| 5 | 23.314 |
| 10 | 52.457 |
| 50 | 285.6 |
| 100 | 577.029 |
| 200 | 1159.996 |

Figure 25A:
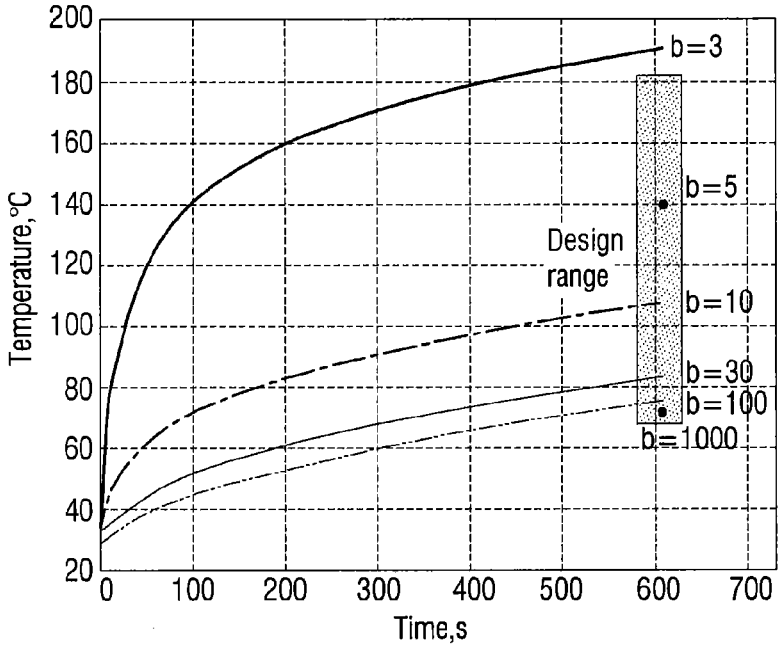
FIGS. 25A-25B are graphs illustrating changes of temperature of a paper non-contact area according to changes of resistance of the paper non-contact area.
Figure 25B:
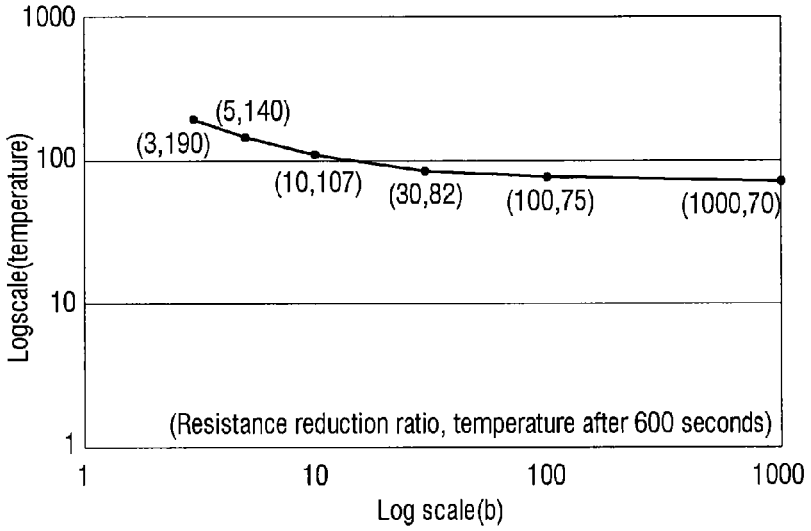

FIGS. 25A-25B are graphs illustrating changes of temperature of the paper non-contact area L2 according to changes of resistance of the paper non-contact area L2. FIG. 25A illustrates a graph illustrating changes of temperature of the paper non-contact area L2 depending on time change and change of the resistance reduction ratio b. FIG. 25B is a graph illustrating temperatures reached after 600 seconds according to change of the resistance reduction ratio b. FIGS. 25A and 25B illustrate the results interpreting temperature changes depending on the resistance reduction of the paper non-contact area L2 when the image fusing apparatus 5 is early heated and maintains a control temperature to 180° C. in the paper contact area L1 of the heating belt 10'.

Referring to FIGS. 25A-25B, it is found that when the resistance of the paper non-contact area L2 is less than ⅓ times of the resistance of the resistance heating layer 12, the temperature of the paper non-contact area L2 is lower than the control temperature. In other words, the result means that if the thickness of the conductive layer 80 is the same as that of the resistance heating layer 12, in order to make the temperature of the paper non-contact area L2 lower than the control temperature, the electrical conductivity of the conductive layer 80 needs to be greater than three times of the electrical conductivity of the resistance heating layer 12. Accordingly, in one or more embodiments, if the thickness and electrical conductivity of the conductive layer 80 is properly adjusted, the temperature of the paper non-contact area L2 may be lower than the control temperature.

In the above description, the conductive layer 80 is disposed between the insulating layer 11 and the resistance heating layer 12. However, position of the conductive layer 80 is not limited to that position. As long as it can lower the electrical resistance of the paper non-contact area L2, the conductive layer 80 may be formed in various positions.

Figure 26:
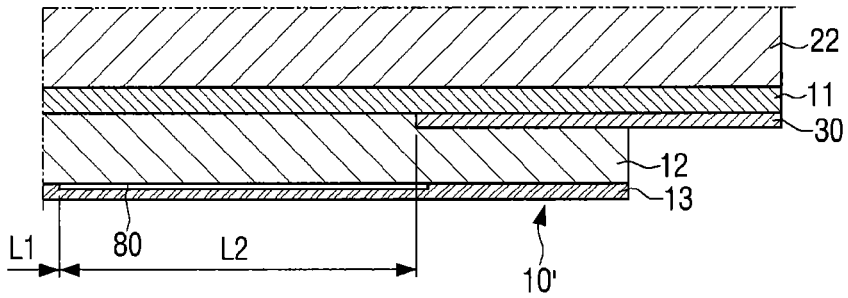
FIG. 26 is a partially sectional view illustrating a heating belt having a conductive layer formed between a resistance heating layer and a release layer thereof.

FIG. 26 illustrates when the conductive layer 80 is formed between the resistance heating layer 12 and the release layer 13.

Figure 27A:
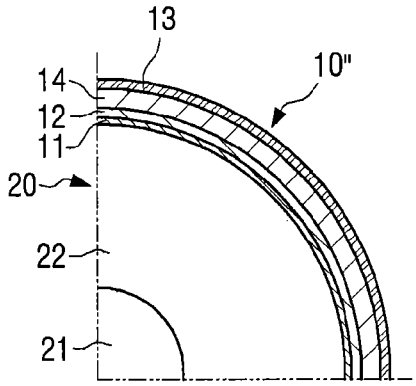
FIGS. 27A-27B are a partially sectional view illustrating a heating belt having a different layer structure.
Figure 27B:
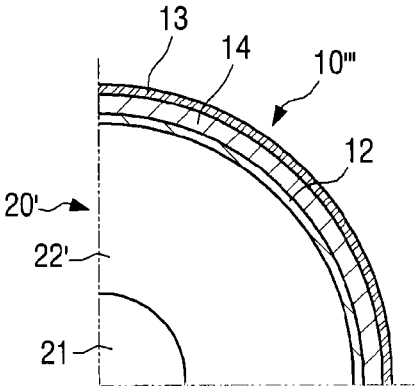
Figure 28A:
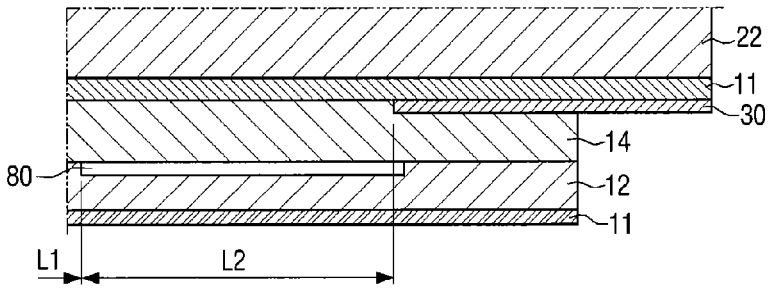
FIGS. 28A-28B are a partially sectional view illustrating a heating belt having a conductive layer formed between a resistance heating layer and an elastic layer thereof.
Figure 28B:
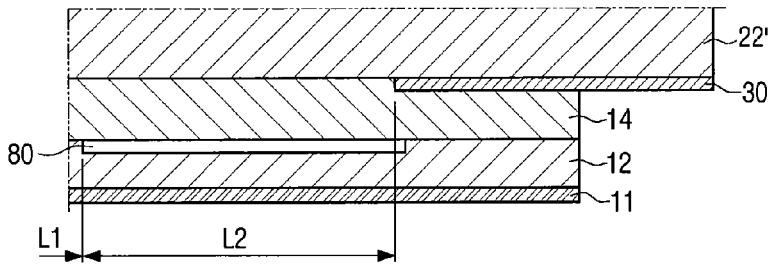

Further, if the heating belt 10" and 10" includes an elastic layer 22 as illustrated in FIGS. 27A-27B, the conductive layer 80 may be formed below the resistance heating layer 12, that is, between the resistance heating layer 12 and the elastic layer 22 as illustrated in FIGS. 28A-28B. Although not illustrated, even if the heating belt 10" and 10" includes an elastic layer 22 as illustrated in of FIGS. 27A-28B, the conductive layer 80 may be disposed close to or in directly contact with the electricity supplying member 30 above on the resistance heating layer 12.

If the conductive layer 80 is formed in the paper non-contact area L2, current flux is congested with depending on the electrical conductivity of the conductive layer 80 so that the electrical resistance of the paper non-contact area L2 is reduced. As a result, temperature lowering effect is generated. Also, if the conductive layer 80 is formed in the paper non-contact area L2, there is no need to change the thickness of the paper non-contact area L2. Therefore, it is easy to manufacture the heating belt.

The heating supporting roller 20, the electricity supplying member 30, and the pressing roller 50 of the image fusing apparatus 5 according to the present embodiment are the same as the heating supporting roller 20, the electricity supplying member 30, and the pressing roller 50 of the image fusing apparatus 1 according to the an embodiment as described above. Therefore, detailed descriptions thereof will be omitted.

Figure 29:
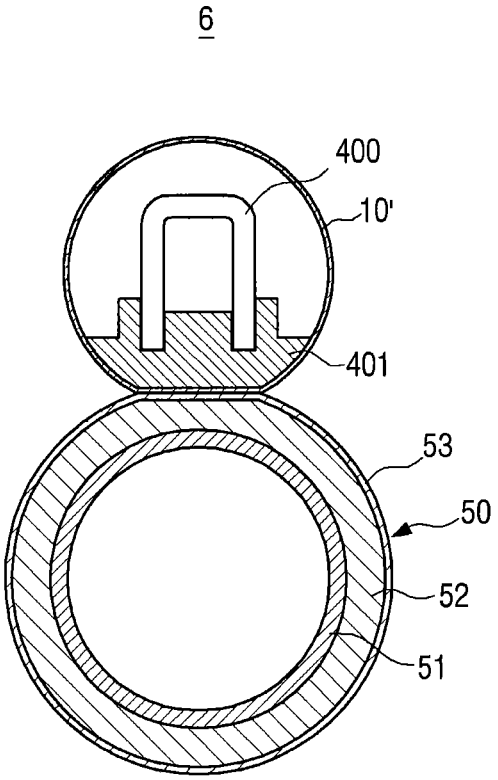
FIG. 29 is a partially sectional view illustrating an image fusing apparatus having a nip forming member according to an embodiment.

FIG. 29 illustrates an image fusing apparatus 6 supporting the heating belt 10' by a heating supporting member configured of a pressure supporting member 400 and a nip forming member 401 instead of the heating supporting roller 20 unlike embodiments as described above. The pressure supporting member 400 is fixed inside the heating belt 10' and supports and pressures the nip forming member 401 toward the pressing roller 50. The nip forming member 401 supports the heating belt 10' and then allows the heating belt 10' to form a nip having a predetermined width with the pressing roller 50. In this embodiment, when the pressing roller 50 rotates, the pressure supporting member 400 and the nip forming member 401 are not rotated but only the heating belt 10' is rotated by the pressing roller 50.

In this embodiment, also the heating belt 10' includes the conductive layer 80 in order to lower the electrical resistance of the paper non-contact area L2.

Even if as illustrated in FIGS. 18, 19 and 20, the heating supporting roller 20 has a hollow cylindrical shape with no elastic layer 14, the heating belt 10' having the conductive layer 80 in the paper non-contact area L2 can be used.

In FIG. 18, the hollow cylinder 20' is formed of a conductive rigid material. Accordingly, the insulating layer 11 is formed on the surface of the hollow cylinder 20', and the resistance heating layer 12 and the release layer 13 are in sequence laminated on the insulating layer 11 so as to form the heating roller 20*a*. At this time, since the heating supporting roller 20' is a rigid member, it is difficult to form a nip. Accordingly, the pressing roller 50' may be formed to have an elastic layer 52 or an auxiliary pressing roller 55 may additionally be disposed to increase the area of the nip.

FIG. 19 illustrates the hollow cylinder 20" formed of a non-conductive rigid material. Accordingly, the insulating layer 11 is not formed on the surface of the hollow cylinder 20". The resistance heating layer 12 is formed directly on the surface of the hollow cylinder 20" and the release layer 13 is formed on the resistance heating layer 12 so as to form the heating roller 20*b*. At this time, since the heating supporting roller 20" is a rigid member, it is difficult to form a nip. Accordingly, the pressing roller 50' may be formed to have an elastic layer 52 or an auxiliary pressing roller 55 may additionally be disposed to increase the area of the nip.

FIG. 20 is a sectional view schematically illustrating the image fusing apparatus 4 using the pressing belt assembly 300 instead of the pressing roller 50' of the image fusing apparatus 2 as illustrated in FIG. 18 in order to form a sufficient nip. In this case, the pressing belt 301 supported to move endlessly in a closed loop by the pair of supporting rollers 302 and 303 can form a sufficient nip with the rigid heating roller 20*a*.

Even when the heating supporting roller 20' is formed of a rigid material, the temperature of the paper non-contact area L2 can be prevented from increasing by forming the conductive layer 80 in the resistance heating layer 12 of the paper non-contact area L2 so as to lower the electrical resistance as describe above.

Figure 30:
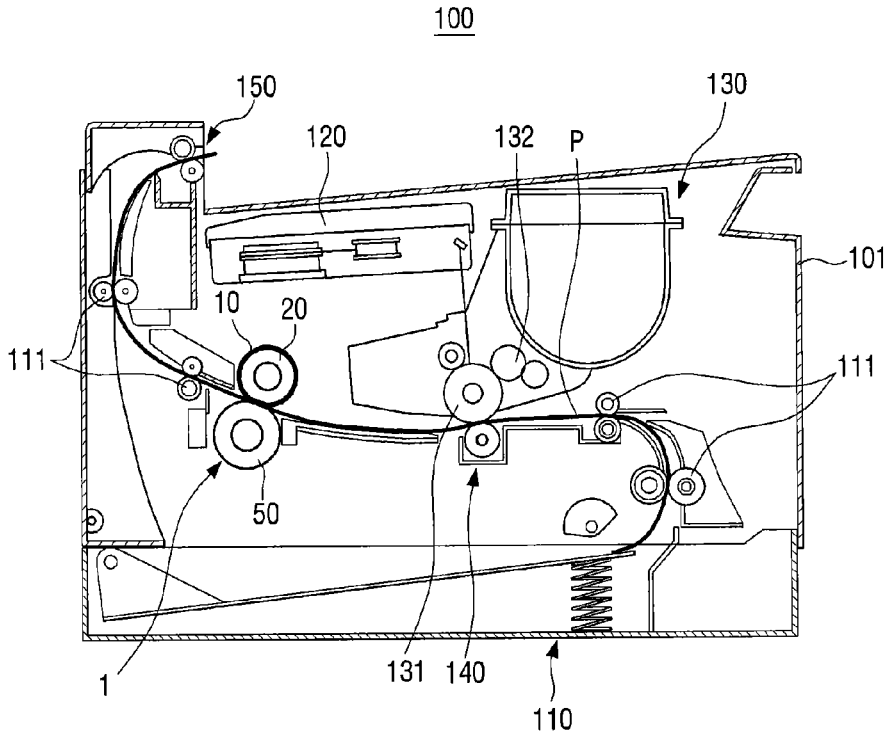
FIG. 30 is a sectional view schematically illustrating an image forming apparatus having an image fusing apparatus according to an embodiment.

Hereinafter, an image forming apparatus having the image fusing apparatus according to an embodiment will be explained. FIG. 30 is a sectional view schematically illustrating an image forming apparatus having the image fusing apparatus according to an embodiment.

The image forming apparatus 100 according to an embodiment prints by an electro photographic image forming method and may include laser printers, copiers, facsimile machines, multifunctional products, or the like.

Referring to FIG. 30, the image forming apparatus 100 according to an embodiment may include a case 101, a paper feeding apparatus 110, a developing apparatus 130, the image fusing apparatus 1, and a paper discharging apparatus 150.

The case 101 forms the outer appearance of the image forming apparatus 100 and supports the paper feeding apparatus 110, the developing apparatus 130, the image fusing apparatus 1, and the paper discharging apparatus 150.

The paper feeding apparatus 110 stores several printing media P, picks up the printing medium P one by one, and supplies the picked up printing medium P to the developing apparatus 130. The printing medium P supplied from the paper feeding apparatus 110 is conveyed to the developing apparatus 130 by the plurality of conveying rollers 111.

The developing apparatus 130 forms a predetermined image on the printing medium P supplied from the paper feeding apparatus 110. The developing apparatus 130 may include a photosensitive medium 131 on which a predetermined electrostatic latent image is formed by an exposure apparatus 120, a developing roller 132 that supplies the photosensitive medium 131 with developer to develop the electrostatic latent image into a developer image, and a transfer roller 140 that transfers the developer image formed on the photosensitive medium 131 onto the printing medium P. After the printing medium P passes through a transfer nip between the photosensitive medium 131 and the transfer roller 140, the developer image is transferred onto the printing medium P.

The image fusing apparatus 1 fuses the transferred developer image onto the printing medium P and includes the heating belt 10, the heating supporting roller 20, and the pressing roller 50. When the printing medium P enters the nip between the heating belt 10 and the pressing roller 50 of the image fusing apparatus 1, the developer image is fused on the printing medium P by predetermined heat and pressure. At this time, the image fusing apparatus 1 according to an exemplary embodiment of the present disclosure is not overheated even continuous printing since temperature of the paper non-contact area L2 of the heating belt 10 is low.

After fusing is completed, the printing medium P is discharged outside the image forming apparatus 100 through the conveying rollers 111 and the paper discharging apparatus 150.

As described above, since the image forming apparatus according to an exemplary embodiment of the present disclosure is structured so that during printing temperature of the paper non-contact area does not rise significantly, even continuous printing the image forming apparatus is not damaged by heat.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image fusing apparatus comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with the outer surface of the heating belt to form a nip; and an electricity supplying member to supply electricity to the resistance heating layer of the heating belt, wherein a thickness of paper non-contact areas of opposite side end portions of the resistance heating layer of the heating belt is the same as or thicker than the thickness of a paper contact area of a middle portion of the resistance heating layer thereof, wherein the resistance heating layer is formed so that carbon nano-tubes on which metal as a conductive filler is doped are dispersed in a silicon rubber or a polyamide of an elastic member, wherein the electricity supplying member is positioned on opposite ends of the heating supporting roller to supply electricity to the resistance heating layer, wherein the electricity supplying member is formed in a cap shape to wrap one end of the heating supporting roller, and wherein the cap shape electricity supplying member is supplied with electricity by a brush that is positioned in contact with the cap shape electricity supplying member in an axial direction of the heating supporting roller.

2. The image fusing apparatus of claim 1, wherein a width of the paper contact area of the resistance heating layer is the same as that of a maximum size printing medium that the resistance heating layer can fuse.

3. The image fusing apparatus of claim 1, wherein the thickness of the paper non-contact area of the resistance heating layer is once to three times to the thickness of the paper contact area.

4. The image fusing apparatus of claim 1, wherein an outer diameter of the resistance heating layer is constant throughout a whole length of the resistance heating layer, an outer diameter of the heating supporting roller is constant throughout a whole length of the heating supporting roller, and the insulating layer, which is positioned between the resistance heating layer and the heating supporting roller has an outer diameter that complementarily changes depending on change of thickness of the resistance heating layer throughout a whole length of the insulating layer.

5. The image fusing apparatus of claim 1, wherein:

an outer diameter of the resistance heating layer is constant throughout a whole length of the resistance heating layer, an outer diameter of the heating supporting roller has steps corresponding to the thickness of the resistance heating layer, and the insulating layer has the same thickness through a whole length of the insulating layer.

6. The image fusing apparatus of claim 1, further comprising:

an inner supporting cap supporting an inner surface of the cap shape electricity supplying member; and an outer fixing cap that supports an outer surface of the cap shape electricity supplying member and fixes the cap shape electricity supplying member with respect to the resistance heating layer of the heating supporting roller.

7. The image fusing apparatus of claim 1, wherein the heating supporting roller comprises:

an elastic layer supporting the heating belt and formed in a cylindrical shape; and a center shaft positioned at a center of the elastic layer.

8. The image fusing apparatus of claim 7, wherein the pressing roller is formed so that an elastic layer and a release layer are in sequence laminated on a pressing rotation shaft.

9. The image fusing apparatus of claim 1, wherein:

the heating supporting roller comprises:

a hollow cylinder having a width corresponding to the heating belt; and a pair of supporting shafts positioned on opposite ends of the hollow cylinder, and the hollow cylinder and the pair of supporting shafts are formed of a metal.

10. The image fusing apparatus of claim 9, further comprising:

an auxiliary pressing roller spaced apart at a predetermined interval from the pressing roller, the auxiliary pressing roller positioned to press the heating belt to the heating supporting roller.

11. The image fusing apparatus of claim 9, wherein the pressing roller comprises at least two supporting rollers and a pressing belt rotated by the at least two supporting rollers.

12. The image fusing apparatus of claim 1, wherein the heating belt comprises an elastic layer formed between the resistance heating layer and the release layer.

13. An image fusing apparatus, comprising:

a heating belt including a resistance heating layer, a release layer formed on an outer surface of the resistance heating layer and an electricity supplying member supplying electricity to the resistance heating layer;

a heating roller positioned inside the heating belt and comprising a non-conductive shaft in contact with the resistance heating layer; and a pressing roller positioned parallel to the heating roller and to be in contact with an outer surface of the heating belt to form a nip, wherein a thickness of paper non-contact areas of opposite side end portions of the resistance heating layer of the heating belt is the same as or thicker than a thickness of a paper contact area of a middle portion of the resistance heating layer thereof, wherein the resistance heating layer is formed so that carbon nano-tubes on which metal as a conductive filler is doped are dispersed in a silicon rubber or a polyamide of an elastic member, wherein the electricity supplying member is positioned on opposite ends of the heating supporting roller to supply electricity to the resistance heating layer, wherein the electricity supplying member is formed in a cap shape to wrap one end of the heating supporting roller, and wherein the cap shape electricity supplying member is supplied with electricity by a brush that is positioned in contact with the cap shape electricity supplying member in an axial direction of the heating supporting roller.

14. The image fusing apparatus of claim 13, wherein:

a width of the paper contact area of the resistance heating layer is the same as that of a maximum size printing medium that the resistance heating layer can fuse, and the thickness of the opposite side end portions of the resistance heating layer is once to three times to the thickness of the middle portion.

15. An image fusing apparatus, comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with an outer surface of the heating belt to form a nip; and a pair of electricity supplying members to supply electricity to the resistance heating layer of the heating belt and positioned on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt, wherein the resistance heating layer is formed so that carbon nano-tubes on which metal as a conductive filler is doped are dispersed in a silicon rubber or a polyamide of an elastic member, and wherein the electricity supplying member comprises:

a body portion positioned at one end of the heating supporting roller and wrapped around an outer circumference of the heating supporting roller, and a plurality of projecting portions formed to project at a predetermined interval from the body portion and positioned in contact with the resistance heating layer of the heating belt; and the plurality of projecting portions form the plurality of contacting portions.

16. The image fusing apparatus of claim 15, wherein each of the plurality of contacting portions is formed in a band shape.

17. The image fusing apparatus of claim 16, wherein the plurality of contacting portions is inclined with respect to a center shaft of the heating supporting roller.

18. An image fusing apparatus, comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with an outer surface of the heating belt to form a nip; and a pair of electricity supplying members to supply electricity to the resistance heating layer of the heating belt and positioned on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt, wherein the electricity supplying member comprises:

a body portion positioned at one end of the heating supporting roller, and an extension portion extended from the body portion to correspond to a paper non-contact area of the heating belt; and an electrode insulating layer is positioned between the extension portion and the resistance heating layer of the heating belt, a plurality of through holes having a predetermined shape is formed on the electrode insulating layer in a circumferential direction of the heating supporting roller, and the resistance heating layer and the electricity supplying member are electrically connected with each other through a material forming the resistance heating layer and filling up the plurality of through holes.

19. An image fusing apparatus, comprising:

a heating belt including a resistance heating layer, a release layer formed on an outer surface of the resistance heating layer, and a conductive layer;

a heating supporting member positioned inside the heating belt and supporting rotation of the heating belt;

a pressing roller positioned parallel to the heating supporting member and to be in contact with an outer surface of the heating belt to form a nip; and an electricity supplying member to supply electricity to the resistance heating layer of the heating belt, wherein the conductive layer is formed to be electrically connected with the resistance heating layer on a paper non-contact area of the heating belt, wherein electrical conductivity of the conductive layer is the same as or larger than electrical conductivity of the resistance heating layer, wherein the resistance heating layer is formed so that carbon nano-tubes on which metal as a conductive filler is doped are dispersed in a silicon rubber or a polyamide of an elastic member, and wherein the electrical conductivity of the conductive layer is once to 500 times larger than electrical conductivity of the resistance heating layer.

20. The image fusing apparatus of claim 19, wherein the conductive layer is formed of a conductive resin or metal.

21. The image fusing apparatus of claim 20, wherein when the conductive layer is formed of a metal, the conductive layer is formed of a metal film having a thickness of 1 nm~999 μm.

22. The image fusing apparatus of claim 19, wherein the conductive layer comprises at least one conductive layer formed on at least one between a top surface of the resistance heating layer and a bottom surface of the resistance heating layer.

23. The image fusing apparatus of claim 19, wherein the heating belt comprises an insulating layer formed on a bottom surface of the resistance heating layer.

24. The image fusing apparatus of claim 19, wherein the heating belt comprises an elastic layer formed between the resistance heating layer and the release layer.

25. The image fusing apparatus of claim 19, wherein the heating supporting member comprises a heating supporting roller, and a nip forming member.

26. The image fusing apparatus of claim 25, wherein the nip forming member comprises a pressure supporting member positioned inside the heating belt and supporting the nip forming member toward the pressing roller.

27. The image fusing apparatus of claim 19, wherein the conductive layer of the heating belt is electrically connected with directly the electricity supplying member.

28. The image fusing apparatus of claim 19, wherein the heating belt comprises an insulating layer formed on an inner surface of the resistance heating layer.

29. An image fusing apparatus, comprising:

a heating belt including a resistance heating layer, an elastic layer formed on an outer surface of the resistance heating layer, and a release layer formed on an outer surface of the elastic layer;

a heating supporting member positioned inside the heating belt and supporting rotation of the heating belt;

a pressing roller positioned parallel to the heating supporting member and to be in contact with an outer surface of the heating belt to form a nip; and an electricity supplying member to supply electricity to the resistance heating layer of the heating belt, wherein electrical resistance of a paper non-contact area of opposite side end portions of the heating belt is smaller than electrical resistance of a paper contact area of a middle portion of the heating belt, and wherein the resistance heating layer is formed so that carbon nano-tubes on which metal as a conductive filler is doped are dispersed in a silicon rubber or a polyamide of an elastic member.

30. The image fusing apparatus of claim 29, wherein thickness or electrical conductivity of the resistance heating layer of the paper non-contact area of the heating belt is adjusted to control the electrical resistance.

31. The image fusing apparatus of claim 29, wherein the heating belt comprises an insulating layer formed on an inner surface of the resistance heating layer.

32. An image forming apparatus comprising an image fusing apparatus, the image fusing apparatus comprising:

a heating belt including a resistance heating layer, an elastic layer formed on an outer surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with an outer surface of the heating belt to form a nip; and an electricity supplying member to supply electricity to the resistance heating layer of the heating belt, wherein a thickness of paper non-contact areas of opposite side end portions of the resistance heating layer of the heating belt is the same as or thicker than the thickness of a paper contact area of a middle portion of the resistance heating layer thereof, wherein the resistance heating layer is formed so that carbon nano-tubes on which metal as a conductive filler is doped are dispersed in a silicon rubber or a polyamide of an elastic member, wherein the electricity supplying member is positioned on opposite ends of the heating supporting roller to supply electricity to the resistance heating layer, wherein the electricity supplying member is formed in a cap shape to wrap one end of the heating supporting roller, and wherein the cap shape electricity supplying member is supplied with electricity by a brush that is positioned in contact with the cap shape electricity supplying member in an axial direction of the heating supporting roller.

33. An image fusing apparatus comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt; and an electricity supplying member to supply electricity to the resistance heating layer of the heating belt, wherein a thickness of paper non-contact areas of the resistance heating layer of the heating belt is the same as or thicker than the thickness of a paper contact area of the resistance heating layer thereof, wherein the resistance heating layer is formed so that carbon nano-tubes on which metal as a conductive filler is doped are dispersed in a silicon rubber or a polyamide of an elastic member, and wherein the electricity supplying member comprises:

a body portion positioned at one end of the heating supporting roller and wrapped around an outer circumference of the heating supporting roller, and a plurality of projecting portions formed to project at a predetermined interval from the body portion and positioned in contact with the resistance heating layer of the heating belt; and the plurality of projecting portions form the plurality of contacting portions.

34. An image fusing apparatus, comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt; and a pair of electricity supplying members to supply electricity to the resistance heating layer of the heating belt and positioned on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt, wherein the resistance heating layer is formed so that carbon nano-tubes on which metal as a conductive filler is doped are dispersed in a silicon rubber or a polyamide of an elastic member, and wherein the electricity supplying member comprises:

a body portion positioned at one end of the heating supporting roller and wrapped around an outer circumference of the heating supporting roller, and a plurality of projecting portions formed to project at a predetermined interval from the body portion and positioned in contact with the resistance heating layer of the heating belt; and the plurality of projecting portions form the plurality of contacting portions.

35. An image fusing apparatus, comprising:

a heating belt including a resistance heating layer, a release layer formed on an outer surface of the resistance heating layer, and a conductive layer;

a heating supporting member positioned inside the heating belt and supporting rotation of the heating belt; and an electricity supplying member to supply electricity to the resistance heating layer of the heating belt, wherein the conductive layer is formed to be electrically connected with the resistance heating layer on a paper non-contact area of the heating belt, wherein electrical conductivity of the conductive layer is the same as or larger than electrical conductivity of the resistance heating layer, wherein the resistance heating layer is formed so that carbon nano-tubes on which metal as a conductive filler is doped are dispersed in a silicon rubber or a polyamide of an elastic member, and wherein the electrical conductivity of the conductive layer is once to 500 times larger than electrical conductivity of the resistance heating layer.

36. An image fusing apparatus, comprising:

a heating belt includes a resistance heating layer, and a release layer formed on an outer surface of the resistance heating layer;

a heating supporting member positioned inside the heating belt and supporting rotation of the heating belt; and an electricity supplying member to supply electricity to the resistance heating layer of the heating belt, wherein electrical resistance of a paper non-contact area of opposite side end portions of the heating belt is smaller than electrical resistance of a paper contact area of a middle portion of the heating belt, and wherein the resistance heating layer is formed so that carbon nano-tubes on which metal as a conductive filler is doped are dispersed in a silicon rubber or a polyamide of an elastic member.

37. An image fusing apparatus comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with the outer surface of the heating belt to form a nip; and an electricity supplying member to supply electricity to the resistance heating layer of the heating belt, wherein a thickness of paper non-contact areas of opposite side end portions of the resistance heating layer of the heating belt is the same as or thicker than the thickness of a paper contact area of a middle portion of the resistance heating layer thereof, wherein the electricity supplying member is positioned on opposite ends of the heating supporting roller to supply electricity to the resistance heating layer, wherein the electricity supplying member is formed in a cap shape to wrap one end of the heating supporting roller, and wherein the cap shape electricity supplying member is supplied with electricity by a brush that is positioned in contact with the cap shape electricity supplying member in an axial direction of the heating supporting roller.

38. The image fusing apparatus of claim 37, further comprising:

an inner supporting cap supporting an inner surface of the cap shape electricity supplying member; and an outer fixing cap that supports an outer surface of the cap shape electricity supplying member and fixes the cap shape electricity supplying member with respect to the resistance heating layer of the heating supporting roller.

39. An image fusing apparatus comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with the outer surface of the heating belt to form a nip; and an electricity supplying member to supply electricity to the resistance heating layer of the heating belt, wherein a thickness of paper non-contact areas of opposite side end portions of the resistance heating layer of the heating belt is the same as or thicker than the thickness of a paper contact area of a middle portion of the resistance heating layer thereof, and wherein the heating belt comprises an elastic layer formed between the resistance heating layer and the release layer.

40. An image fusing apparatus, comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with an outer surface of the heating belt to form a nip; and a pair of electricity supplying members to supply electricity to the resistance heating layer of the heating belt and positioned on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt, and wherein:

the electricity supplying member comprises:

a body portion positioned at one end of the heating supporting roller; and an extension portion extended from the body portion to correspond to a paper non-contact area of the heating belt, wherein an electrode insulating layer is positioned between the extension portion and the resistance heating layer of the heating belt, a plurality of through holes having a predetermined shape is formed on the electrode insulating layer in a circumferential direction of the heating supporting roller, and the resistance heating layer and the electricity supplying member are electrically connected with each other through a material forming the resistance heating layer and filling up the plurality of through holes.

41. An image fusing apparatus, comprising:

a heating belt including a resistance heating layer, an insulating layer formed on an inner surface of the resistance heating layer, and a release layer formed on an outer surface of the resistance heating layer;

a heating supporting roller positioned inside the heating belt and rotating with the heating belt;

a pressing roller positioned parallel to the heating supporting roller and to be in contact with an outer surface of the heating belt to form a nip; and a pair of electricity supplying members to supply electricity to the resistance heating layer of the heating belt and positioned on opposite ends of the heating supporting roller along an outer circumference of the heating supporting roller, wherein the electricity supplying member and the resistance heating layer are electrically connected with each other through a plurality of contacting portions formed in a predetermined shape in a circumferential direction of the heating belt, and wherein each of the plurality of contacting portions is formed in a band shape.

42. The image fusing apparatus of claim 41, wherein the plurality of contacting portions is inclined with respect to a center shaft of the heating supporting roller.

43. An image fusing apparatus, comprising:

a heating belt including a resistance heating layer, a release layer formed on an outer surface of the resistance heating layer, and a conductive layer;

a heating supporting member positioned inside the heating belt and supporting rotation of the heating belt;

a pressing roller positioned parallel to the heating supporting member and to be in contact with an outer surface of the heating belt to form a nip; and an electricity supplying member to supply electricity to the resistance heating layer of the heating belt, wherein the conductive layer is formed to be electrically connected with the resistance heating layer on a paper non-contact area of the heating belt, wherein electrical conductivity of the conductive layer is the same as or larger than electrical conductivity of the resistance heating layer, and wherein the electrical conductivity of the conductive layer is once to 500 times larger than electrical conductivity of the resistance heating layer.

44. An image fusing apparatus, comprising:

a heating belt including a resistance heating layer, a release layer formed on an outer surface of the resistance heating layer, and a conductive layer;

a heating supporting member positioned inside the heating belt and supporting rotation of the heating belt;

a pressing roller positioned parallel to the heating supporting member and to be in contact with an outer surface of the heating belt to form a nip; and an electricity supplying member to supply electricity to the resistance heating layer of the heating belt, wherein the conductive layer is formed to be electrically connected with the resistance heating layer on a paper non-contact area of the heating belt, wherein electrical conductivity of the conductive layer is the same as or larger than electrical conductivity of the resistance heating layer, wherein the conductive layer is formed of a conductive resin or metal, and wherein when the conductive layer is formed of a metal, the conductive layer is formed of a metal film having a thickness of 1 nm~999 μm.

* * * * *